US009069275B2

(12) United States Patent
Veregin et al.

(10) Patent No.: US 9,069,275 B2
(45) Date of Patent: Jun. 30, 2015

(54) CARRIER RESINS WITH IMPROVED RELATIVE HUMIDITY SENSITIVITY

(71) Applicants: XEROX CORPORATION, Norwalk, CT (US); NATIONAL RESEARCH COUNCIL OF CANADA ("NRCC"), Ottawa (CA)

(72) Inventors: Richard P. Veregin, Mississauga (CA); Qingbin Li, Edmonton (CA); Andriy Kovalenko, Edmonton (CA); Sergey Gusarov, Edmonton (CA); Darren Makeiff, St. Albert (CA); Valerie Farrugia, Oakville (CA); Michael S. Hawkins, Cambridge (CA)

(73) Assignees: XEROX CORPORATION, Norwalk, CT (US); NATIONAL RESEARCH COUNCIL OF CANADA, Ottawa (CA)

( * ) Notice: Subject to any disclaimer, the term of this patent is extended or adjusted under 35 U.S.C. 154(b) by 135 days.

(21) Appl. No.: 13/856,267

(22) Filed: Apr. 3, 2013

(65) Prior Publication Data

US 2014/0302435 A1 Oct. 9, 2014

(51) Int. Cl.
*G03G 9/10* (2006.01)
*G03G 9/113* (2006.01)

(52) U.S. Cl.
CPC ..... *G03G 9/1133* (2013.01); *Y10T 428/2982* (2015.01)

(58) Field of Classification Search
USPC ..... 430/111.35
See application file for complete search history.

(56) References Cited

U.S. PATENT DOCUMENTS

| | | | |
|---|---|---|---|
| 3,590,000 | A | 6/1971 | Palermiti et al. |
| 3,655,374 | A | 4/1972 | Palermiti et al. |
| 3,720,617 | A | 3/1973 | Chatterji et al. |
| 3,944,493 | A | 3/1976 | Jadwin et al. |
| 3,983,045 | A | 9/1976 | Jugle et al. |
| 4,007,293 | A | 2/1977 | Mincer et al. |
| 4,079,014 | A | 3/1978 | Burness et al. |
| 4,295,990 | A | 10/1981 | Verbeek et al. |
| 4,394,430 | A | 7/1983 | Jadwin et al. |
| 4,457,998 | A | 7/1984 | Gruber et al. |
| 4,560,635 | A | 12/1985 | Hoffend et al. |
| 4,935,326 | A | 6/1990 | Creatura et al. |
| 4,937,166 | A | 6/1990 | Creatura et al. |
| 4,973,540 | A | 11/1990 | Machida et al. |
| 5,290,654 | A | 3/1994 | Sacripante et al. |
| 5,302,486 | A | 4/1994 | Patel et al. |
| 5,376,172 | A | 12/1994 | Tripp et al. |
| 5,556,732 | A | 9/1996 | Chow et al. |

(Continued)

FOREIGN PATENT DOCUMENTS

JP 2005-010183 * 1/2005 ..... G03G 9/113

OTHER PUBLICATIONS

Translation of JP 2005-01083 published Jan. 2005.*

*Primary Examiner* — Peter Vajda
(74) *Attorney, Agent, or Firm* — Pillsbury Winthrop Shaw Pittman LLP

(57) ABSTRACT

The disclosure generally describes carrier resins, and in particular, resins used for carrier coatings which include at least one ester functional group and at least one cyclic aliphatic group containing at least one nitrogen atom in the cyclic ring structure. Carriers having such resins in the coating exhibit high charge and excellent relative humidity (RH) sensitivity of charge to changing environmental conditions.

19 Claims, 1 Drawing Sheet

(56) References Cited

U.S. PATENT DOCUMENTS

| | | | |
|---|---|---|---|
| 6,004,714 | A | 12/1999 | Ciccarelli et al. |
| 6,042,981 | A | 3/2000 | Barbetta et al. |
| 6,063,827 | A | 5/2000 | Sacripante et al. |
| 6,190,815 | B1 | 2/2001 | Ciccarelli et al. |
| 6,355,391 | B1 | 3/2002 | Van Dusen et al. |
| 6,593,049 | B1 | 7/2003 | Veregin et al. |
| 6,756,176 | B2 | 6/2004 | Stegamat et al. |
| 6,830,860 | B2 | 12/2004 | Sacripante et al. |
| 7,014,971 | B2 | 3/2006 | Skorokhod et al. |
| 7,524,602 | B2 | 4/2009 | Vanbesien et al. |
| 2011/0236815 | A1* | 9/2011 | Veregin et al. ..... 430/108.4 |

* cited by examiner

CARRIER RESINS WITH IMPROVED RELATIVE HUMIDITY SENSITIVITY

BACKGROUND

The disclosure relates generally to carrier resins, and in particular, resins used for carrier coatings which include at least one ester functional group and at least one cyclic aliphatic group containing at least one nitrogen atom in the cyclic ring structure. Carriers having such resins in the coating exhibit high charge and excellent relative humidity (RH) sensitivity of charge to changing environmental conditions. The nitrogen containing groups have been shown by modeling to have a much lower barrier to charge transfer than the best performing conventional resins, especially with silica as a toner additive on the toner, and thus will provide for the desired higher toner charge.

Toners can comprise at least a binder resin, a colorant and one or more external surface additives. The external surface additives can be added in small amounts. Examples of external surface additives include, for example, silica, titanium dioxide, zinc stearate and the like.

The properties of a toner are influenced by the materials and amounts of the materials of the toner. The charging characteristics of a toner also can depend on the carrier used in a developer composition, such as, the carrier coating.

Toners having triboelectric charge within the range of about −30 μC/g to about −45 μC/g may be achieved by including smaller-sized silica particles as external additives, for example silica particles having average sizes of less than about 20 nm, such as, for example, R805 (~12 nm) and/or R972 (~16 nm) (Evonik, NJ). However, developability at areas of low toner area coverage degrades over time. That has been attributed to the smaller-sized additives being impacted into the toner surface over time.

The problem with smaller-sized additives may be addressed by using larger-sized additives, i.e., additives having a size of about 40 nm or larger such as, for example, RX50 silica, RX515H silica or SMT5103 titania (Evonik, NJ). However, such toners do not exhibit as high a triboelectric charge and also exhibit charge through. New carrier coatings are being developed that enable higher charge developers, particularly those with larger-sized additive packages. However, when such developers are tested at low area coverage followed by high area coverage, the developers tend to exhibit low or wrong sign toner due to charge through, i.e., the incumbent toner in the device becomes less negative or even of the wrong sign, that is, the opposite charge, i.e., positive, and the new (fresh) toner added may charge very negative. The presence of low charge and/or wrong sign toner can result in objectionable background.

There remain problems with providing high charge with good relative humidity (RH) sensitivity of charge to changing environmental conditions for carrier coating resin designs. For example, there remains a need to tune the charge of the carrier resin to produce higher charge. Further, many toners contain silica as a surface additive. Silica can be a substantial charge driver for a toner, although silica is known to be RH sensitive. Hence, it is a goal to provide new carrier designs that work well with silica to improve RH sensitivity, while maintaining high charge.

In addition, a high carbon content and high carbon:oxygen (C/O) ratios provide the best RH sensitivity, but charge is insufficient without the addition of heteroatoms such as nitrogen. However, because nitrogen is polar, such linear alkyl substituted nitrogen compounds tend to make RH sensitivity worse while tending to soften the resin and lower Tg. Thus, there is also a need for higher carbon content nitrogen-containing compounds that do not compromise the hardness and do not lower Tg.

SUMMARY

The present embodiments provide a carrier coating comprising one or more monomers having at least one ester functional group and at least one cyclic aliphatic group containing at least one nitrogen atom in the ring structure.

In specific embodiments, there is provided a toner carrier comprising: a carrier core; and a carrier coating disposed over the carrier core, wherein the carrier coating comprises one or more monomers having at least one ester functional group and at least one cyclic aliphatic group containing at least one nitrogen atom in the ring structure.

In yet other embodiments, there is provided a developer comprising: a toner; and a toner carrier, the toner carrier comprising a carrier core, and a carrier coating disposed over the carrier core, wherein the carrier coating comprises one or more monomers having at least one ester functional group and at least one cyclic aliphatic group containing at least one nitrogen atom in the ring structure.

BRIEF DESCRIPTION OF THE DRAWING

The foregoing summary, embodiments, and other aspects of the present disclosure will be best understood with reference to a description of embodiments, which follows, when read in conjunction with the accompanying drawing.

DETAILED DESCRIPTION

Figure 1:
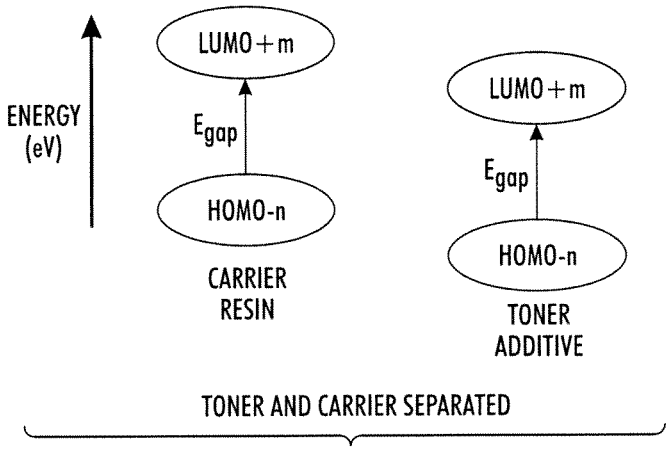
FIG. 1 shows a schematic diagram of highest occupied molecular orbital (HOMO) and lowest unoccupied molecular orbital (LUMO) energies for carrier resin and toner additive.

The disclosure relates to aliphatic cyclic nitrogen-containing carrier resins of high charge and improved RH sensitivity.

In embodiments, a carrier composition is disclosed including a polymer coating resin containing at least one ester functional group and at least one cyclic aliphatic group containing at least one nitrogen atom in the cyclic ring structure. In embodiments, suitable monomers with an ester functional group include acrylates and methacrylates. In embodiments, suitable aliphatic cyclic groups containing nitrogen include an N-alkyl piperidinyl moiety, rings containing an amide or amine moiety with a tertiary N, and rings containing a nitroxyl moiety. The nitrogen may be located in any position in the ring.

Herein, use of the singular includes the plural unless specifically stated otherwise. Use of, "or," means, "and/or," unless stated otherwise. Furthermore, use of the term, "including," as well as other forms, such as, "includes," and, "included," is not limiting.

"Toner," "developer," "toner composition" and "toner particle," can be used interchangeably, and any particular or specific use and meaning will be evident from the context of the sentence, paragraph and the like in which the word or phrase appears. In embodiments, a toner is a powdery ink used dry or suspended in a liquid to produce a photocopy.

As used herein, the modifier, "about," used in connection with a quantity is inclusive of the stated value and has the meaning dictated by the context (for example, it includes at least the degree of error associated with the measurement of the particular quantity). When used in the context of a range, the modifier, "about," should also be considered as disclosing the range defined by the absolute values of the two endpoints. For example, the range, "from about 2 to about 4," also discloses the range, "from 2 to 4."

An, "alkyl," group is a saturated, partially saturated, or unsaturated straight chain or branched non-cyclic hydrocarbon having from 1 to about 10 carbon atoms, typically from 1 to about 8 carbons or, in embodiments, from 1 to about 6, 1 to about 4, or 2 to about 6 carbon atoms. An alkyl group can be substituted or unsubstituted.

A, "cyclic alkyl," or "cycloalkyl" or "cyclic aliphatic" group is a saturated, group of typically from 3 to about 10 carbon atoms having a single cyclic ring or multiple condensed or bridged rings, but up to about 20 carbon atoms. Larger cyclic alkyl groups than 20 carbon atoms are typically known as "cycloparaffin" groups. In embodiments, the cycloalkyl group has 3 to about 8 ring members, in embodiments, the number of ring carbon atoms ranges from 3 to about 5, 3 to about 6 or 3 to about 7. A cycloalkyl group can be unsubstituted or substituted with other groups, including additional alkyl groups or heteroatoms An, "aryl," group is an aromatic carbocyclic group of from about 6 to about 14 carbon atoms having a single ring (e.g., phenyl) or multiple condensed rings (e.g., naphthyl or anthryl). In embodiments, aryl groups contain about 6 to about 14 carbon atoms, in embodiments, from about 6 to about 12 or about 6 to about 10 carbon atoms in the ring portions of the groups. An aryl group can be unsubstituted or substituted with other groups, including additional alkyl groups or heteroatoms.

The phrase, "aryl groups," also includes groups containing fused rings, such as fused aromatic-aliphatic ring systems (e.g., indanyl, tetrahydronaphthyl and the like).

By negative additives that are negatively chargeable to a reference carrier is meant that the additives are negatively charging relative to the toner surface measured by determining the toner triboelectric charge with and without the additive. Similarly, by positive additives that are positively chargeable to a carrier is meant that the additives are positively charging relative to the toner surface measured by determining the toner triboelectric charge with and without the additive.

Negative additives that are negatively chargeable to a carrier include, for example, silica particles, alumina particles or any small-sized particles (e.g., from about 7 to about 100 nm in volume average particle diameter as determined by any suitable technique) including, for example, polymeric microspheres, optionally treated with a composition rendering the particles negatively chargeable to a carrier on triboelectric contact therewith. The treating material may be, for example, a fluorosilane, for example, such as exemplified in U.S. Pat. No. 4,973,540, incorporated herein by reference in entirety, other halogen-containing organosilanes, such as described in U.S. Pat. No. 5,376,172, incorporated herein by reference in entirety, silazanes, siloxanes and the like.

Emulsion Aggregation Toners

In embodiments, a developer is disclosed including a resin coated carrier and a toner, where the toner may be an emulsion aggregation toner, containing, but not limited to, a latex resin, a wax and a polymer shell.

In embodiments, a latex resin for the toner may be composed of a first and a second monomer composition. Any suitable monomer or mixture of monomers may be selected to prepare the first monomer composition and the second monomer composition. The selection of monomer or mixture of monomers for the first monomer composition is independent of that for the second monomer composition and vise versa. Exemplary monomers for the first and/or the second monomer compositions include, but are not limited to, polyesters, styrene, alkyl acrylate, such as, methyl acrylate, ethyl acrylate, butyl arylate, isobutyl acrylate, dodecyl acrylate, n-octyl acrylate, 2-chloroethyl acrylate; β-carboxy ethyl acrylate (β-CEA), phenyl acrylate, methyl alphachloroacrylate, methyl methacrylate, ethyl methacrylate and butyl methacrylate; butadiene; isoprene; methacrylonitrile; acrylonitrile; vinyl ethers, such as, vinyl methyl ether, vinyl isobutyl ether, vinyl ethyl ether and the like; vinyl esters, such as, vinyl acetate, vinyl propionate, vinyl benzoate and vinyl butyrate; vinyl ketones, such as, vinyl methyl ketone, vinyl hexyl ketone and methyl isopropenyl ketone; vinylidene halides, such as, vinylidene chloride and vinylidene chlorofluoride; N-vinyl indole; N-vinyl pyrrolidone; methacrylate; acrylic acid; methacrylic acid; acrylamide; methacrylamide; vinylpyridine; vinylpyrrolidone; vinyl-N-methylpyridinium chloride; vinyl naphthalene; p-chlorostyrene; vinyl chloride; vinyl bromide; vinyl fluoride; ethylene; propylene; butylenes; isobutylene; and the like, and mixtures thereof. In case a mixture of monomers is used, typically the latex polymer will be a copolymer.

In some embodiments, the first monomer composition and the second monomer composition may independently of each other comprise two or three or more different monomers. The latex polymer therefore can comprise a copolymer. Illustrative examples of such a latex copolymer includes poly(styrene-n-butyl acrylate-β-CEA), poly(styrene-alkyl acrylate), poly(styrene-1,3-diene), poly(styrene-alkyl methacrylate), poly(alkyl methacrylate-alkyl acrylate), poly(alkyl methacrylate-aryl acrylate), poly(aryl methacrylate-alkyl acrylate), poly(alkyl methacrylate), poly(styrene-alkyl acrylate-acrylonitrile), poly(styrene-1,3-diene-acrylonitrile), poly (alkyl acrylate-acrylonitrile), poly(styrene-butadiene), poly (methylstyrene-butadiene), poly(methyl methacrylate-butadiene), poly(ethyl methacrylate-butadiene), poly(propyl methacrylate-butadiene), poly(butyl methacrylate-butadiene), poly(methyl acrylate-butadiene), poly(ethyl acrylate-butadiene), poly(propyl acrylate-butadiene), poly(butyl acrylate-butadiene), poly(styrene-isoprene), poly(methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), poly(butyl acrylate-isoprene); poly(styrene-propyl acrylate), polystyrene-butyl acrylate), poly(styrene-butadiene-acrylonitrile), poly(styrene-butyl acrylate-acrylononitrile), and the like.

In embodiments, the first monomer composition and the second monomer composition may be substantially water insoluble, such as, hydrophobic, and may be dispersed in an aqueous phase with adequate stirring when added to a reaction vessel.

The weight ratio between the first monomer composition and the second monomer composition may be in the range of from about 0.1:99.9 to about 50:50, including from about 0.5:99.5 to about 25:75, from about 1:99 to about 10:90.

In embodiments, the first monomer composition and the second monomer composition can be the same. Examples of the first/second monomer composition may be a mixture comprising styrene and alkyl acrylate, such as, a mixture comprising styrene, n-butyl acrylate and β-CEA. Based on total weight of the monomers, styrene may be present in an amount from about 1% to about 99%, from about 50% to about 95%, from about 70% to about 90%, although may be present in greater or lesser amounts; alkyl acrylate, such as, n-butyl acrylate, may be present in an amount from about 1% to about 99%, from about 5% to about 50%, from about 10% to about 30%, although may be present in greater or lesser amounts.

In embodiments, the toner resins may be a polyester resin, such as, an amorphous resin, a crystalline resin, and/or a combination thereof, including the resins described in U.S. Pat. Nos. 6,593,049 and 6,756,176, the disclosure of each of which hereby is incorporated by reference in entirety. Suitable resins may also include a mixture of an amorphous polyester resin and a crystalline polyester resin as described in U.S. Pat. No. 6,830,860, the disclosure of which is hereby incorporated by reference in entirety.

In embodiments, the resin may be a polyester resin formed by reacting a diol with a diacid in the presence of an optional catalyst. For forming a crystalline polyester, suitable organic diols include aliphatic diols with from about 2 to about 36 carbon atoms, such as 1,2-ethanediol, 1,3-propanediol, 1,4-butanediol, 1,5-pentanediol, 1,6-hexanediol, 1,7-heptanediol, 1,8-octanediol, 1,9-nonanediol, 1,10-decanediol, 1,12-dodecanediol and the like; alkali sulfo-aliphatic diols such as sodio 2-sulfo-1,2-ethanediol, lithio 2-sulfo-1,2-ethanediol, potassio 2-sulfo-1,2-ethanediol, sodio 2-sulfo-1,3-propanediol, lithio 2-sulfo-1,3-propanediol, potassio 2-sulfo-1,3-propanediol, mixture thereof, and the like. The aliphatic diol may be, for example, selected in an amount of from about 40 to about 60 mole percent, in embodiments from about 42 to about 55 mole percent, in embodiments from about 45 to about 53 mole percent (although amounts outside of these ranges can be used), and the alkali sulfo-aliphatic diol can be selected in an amount of from about 0 to about 10 mole percent, in embodiments from about 1 to about 4 mole percent of the resin.

Examples of organic diacids or diesters including vinyl diacids or vinyl diesters selected for the preparation of the crystalline resins include oxalic acid, succinic acid, glutaric acid, adipic acid, suberic acid, azelaic acid, sebacic acid, fumaric acid, dimethyl fumarate, dimethyl itaconate, cis, 1,4-diacetoxy-2-butene, diethyl fumarate, diethyl maleate, phthalic acid, isophthalic acid, terephthalic acid, naphthalene-2,6-dicarboxylic acid, naphthalene-2,7-dicarboxylic acid, cyclohexane dicarboxylic acid, malonic acid and mesaconic acid, a diester or anhydride thereof; and an alkali sulfo-organic diacid such as the sodio, lithio or potassio salt of dimethyl-5-sulfo-isophthalate, dialkyl-5-sulfo-isophthalate-4-sulfo-1,8-naphthalic anhydride, 4-sulfo-phthalic acid, dimethyl-4-sulfo-phthalate, dialkyl-4-sulfo-phthalate, 4-sulfophenyl-3,5-dicarbomethoxybenzene, 6-sulfo-2-naphthyl-3,5-dicarbomethoxybenzene, sulfo-terephthalic acid, dimethyl-sulfo-terephthalate, 5-sulfo-isophthalic acid, dialkyl-sulfo-terephthalate, sulfoethanediol, 2-sulfopropanediol, 2-sulfobutanediol, 3-sulfopentanediol, 2-sulfohexanediol, 3-sulfo-2-methylpentanediol, 2-sulfo-3,3-dimethylpentanediol, sulfo-p-hydroxybenzoic acid, N,N-bis(2-hydroxyethyl)-2-amino ethane sulfonate, or mixtures thereof. The organic diacid may be selected in an amount of, for example, in embodiments from about 40 to about 60 mole percent, in embodiments from about 42 to about 52 mole percent, in embodiments from about 45 to about 50 mole percent, and the alkali sulfo-aliphatic diacid can be selected in an amount of from about 1 to about 10 mole percent of the resin.

Examples of crystalline resins include polyesters, polyamides, polyimides, polyolefins, polyethylene, polybutylene, polyisobutyrate, ethylene-propylene copolymers, ethylene-vinyl acetate copolymers, polypropylene, mixtures thereof, and the like. Specific crystalline resins may be polyester based, such as poly(ethylene-adipate), poly(propylene-adipate), poly(butylene-adipate), poly(pentylene-adipate), poly(hexylene-adipate), poly(octylene-adipate), poly(ethylene-succinate), poly(propylene-succinate), poly(butylene-succinate), poly(pentylene-succinate), poly(hexylene-succinate), poly(octylene-succinate), poly(ethylene-sebacate), poly(propylene-sebacate), poly(butylene-sebacate), poly(pentylene-sebacate), poly(hexylene-sebacate), poly(octylene-sebacate), poly(decylene-sebacate), poly(decylene-decanoate), poly(ethylene-decanoate), poly(ethylene dodecanoate), poly(nonylene-sebacate), poly(nonylene-decanoate), copoly(ethylene-fumarate)-copoly(ethylene-sebacate), copoly(ethylene-fumarate)-copoly(ethylene-decanoate), copoly(ethylene-fumarate)-copoly(ethylene-dodecanoate), alkali copoly(5-sulfoisophthaloyl)-copoly(ethylene-adipate), alkali copoly(5-sulfoisophthaloyl)-copoly(propylene-adipate), alkali copoly(5-sulfoisophthaloyl)-copoly(butylene-adipate), alkali copoly(5-sulfo-isophthaloyl)-copoly(pentylene-adipate), alkali copoly(5-sulfo-isophthaloyl)-copoly(hexylene-adipate), alkali copoly(5-sulfo-isophthaloyl)-copoly(octylene-adipate), alkali copoly(5-sulfo-isophthaloyl)-copoly(ethylene-adipate), alkali copoly(5-sulfo-isophthaloyl)-copoly(propylene-adipate), alkali copoly(5-sulfo-isophthaloyl)-copoly(butylene-adipate), alkali copoly(5-sulfoisophthaloyl)-copoly(ethylene-succinate), alkali copoly(5-sulfoisophthaloyl)-copoly(propylene-succinate), alkali copoly(5-sulfoisophthaloyl)-copoly(butylenes-succinate), alkali copoly(5-sulfoisophthaloyl)-copoly(pentylene-succinate), alkali copoly(5-sulfoisophthaloyl)-copoly(hexylene-succinate), alkali copoly(5-sulfoisophthaloyl)-copoly(octylene-succinate), alkali copoly(5-sulfo-isophthaloyl)-copoly(ethylene-sebacate), alkali copoly(5-sulfo-isophthaloyl)-copoly(propylene-sebacate), alkali copoly(5-sulfo-isophthaloyl)-copoly(butylene-sebacate), alkali copoly(5-sulfo-isophthaloyl)-copoly(pentylene-sebacate), alkali copoly(5-sulfo-isophthaloyl)-copoly(hexylene-sebacate), alkali copoly(5-sulfo-isophthaloyl)-copoly(octylene-sebacate), alkali copoly(5-sulfo-isophthaloyl)-copoly(ethylene-adipate), alkali copoly(5-sulfo-isophthaloyl)-copoly(propylene-adipate), alkali copoly(5-sulfo-isophthaloyl)-copoly(butylene-adipate), alkali copoly(5-sulfo-isophthaloyl)-copoly(pentylene-adipate), alkali copoly(5-sulfo-isophthaloyl)-copoly(hexylene-adipate), poly(octylene-adipate), wherein alkali is a metal like sodium, lithium or potassium. Examples of polyamides include poly(ethylene-adipamide), poly(propylene-adipamide), poly(butylenes-adipamide), poly(pentylene-adipamide), poly(hexylene-adipamide), poly(octylene-adipamide), poly(ethylene-succinimide), and poly(propylene-sebecamide). Examples of polyimides include poly(ethylene-adipimide), poly(propylene-adipimide), poly(butylene-adipimide), poly(pentylene-adipimide), poly(hexylene-adipimide), poly(octylene-adipimide), poly(ethylene-succinimide), poly(propylene-succinimide), and poly(butylene-succinimide).

The crystalline resin may be present, for example, in an amount of from about 5 to about 50 percent by weight of the toner components, in embodiments from about 10 to about 35 percent by weight of the toner components. The crystalline resin can possess various melting points of, for example, from about 30° C. to about 120° C., in embodiments from about 50° C. to about 90° C. The crystalline resin may have a number average molecular weight ($M_n$), as measured by gel permeation chromatography (GPC) of, for example, from about 1,000 to about 50,000, in embodiments from about 2,000 to about 25,000, and a weight average molecular weight ($M_w$) of, for example, from about 2,000 to about 100,000, in embodiments from about 3,000 to about 80,000, as determined by Gel Permeation Chromatography using polystyrene standards. The molecular weight distribution ($M_w/M_n$) of the crystalline resin may be, for example, from about 2 to about 6, in embodiments from about 3 to about 4.

Examples of diacids or diesters including vinyl diacids or vinyl diesters utilized for the preparation of amorphous polyesters include dicarboxylic acids or diesters such as terephthalic acid, phthalic acid, isophthalic acid, fumaric acid, dimethyl fumarate, dimethyl itaconate, cis, 1,4-diacetoxy-2-butene, diethyl fumarate, diethyl maleate, maleic acid, succinic acid, itaconic acid, succinic acid, succinic anhydride, dodecylsuccinic acid, dodecylsuccinic anhydride, glutaric acid, glutaric anhydride, adipic acid, pimelic acid, suberic acid, azelaic acid, dodecane diacid, dimethyl terephthalate, diethyl terephthalate, dimethylisophthalate, diethylisophthalate, dimethylphthalate, phthalic anhydride, diethylphthalate, dimethylsuccinate, dimethylfumarate, dimethylmaleate, dimethylglutarate, dimethyladipate, dimethyl dodecylsuccinate, and combinations thereof. The organic diacid or diester may be present, for example, in an amount from about 40 to about 60 mole percent of the resin, in embodiments from about 42 to about 52 mole percent of the resin, in embodiments from about 45 to about 50 mole percent of the resin. Examples of the alkylene oxide adducts of bisphenol include polyoxypropylene (2.2)-2,2-bis(4-hydroxyphenyl) propane, polyoxypropylene (3.3)-2,2-bis(4-hydroxyphenyl) propane, polyoxyethylene (2.0)-2,2-bis(4-hydroxyphenyl) propane, polyoxyethylene (2.2)-2,2-bis(4-hydroxyphenyl) propane, polyoxypropylene (2.0)-polyoxyethylene (2.0)-2,2-bis(4-hydroxyphenyl) propane, and polyoxypropylene (6)-2,2-bis(4-hydroxyphenyl) propane. These compounds may be used singly or as a combination of two or more thereof.

Examples of additional diols which may be utilized in generating the amorphous polyester include 1,2-propanediol, 1,3-propanediol, 1,2-butanediol, 1,3-butanediol, 1,4-butanediol, pentanediol, hexanediol, 2,2-dimethylpropanediol, 2,2,3-trimethylhexanediol, heptanediol, dodecanediol, 1,4-cyclohexanedimethanol, 1,3-cyclohexanedimethanol, xylenedimethanol, cyclohexanediol, diethylene glycol, dipropylene glycol, dibutylene, and combinations thereof. The amount of organic diol selected can vary, and may be present, for example, in an amount from about 40 to about 60 mole percent of the resin, in embodiments from about 42 to about 55 mole percent of the resin, in embodiments from about 45 to about 53 mole percent of the resin.

Polycondensation catalysts which may be utilized in forming either the crystalline or amorphous polyesters include tetraalkyl titanates, dialkyltin oxides such as dibutyltin oxide, tetraalkyltins such as dibutyltin dilaurate, and dialkyltin oxide hydroxides such as butyltin oxide hydroxide, aluminum alkoxides, alkyl zinc, dialkyl zinc, zinc oxide, stannous oxide, or combinations thereof. Such catalysts may be utilized in amounts of, for example, from about 0.01 mole percent to about 5 mole percent based on the starting diacid or diester used to generate the polyester resin.

In embodiments, suitable amorphous resins include polyesters, polyamides, polyimides, polyolefins, polyethylene, polybutylene, polyisobutyrate, ethylene-propylene copolymers, ethylene-vinyl acetate copolymers, polypropylene, combinations thereof, and the like. Examples of amorphous resins which may be utilized include alkali sulfonated-polyester resins, branched alkali sulfonated-polyester resins, alkali sulfonated-polyimide resins, and branched alkali sulfonated-polyimide resins. Alkali sulfonated polyester resins may be useful in embodiments, such as the metal or alkali salts of copoly(ethylene-terephthalate)-copoly(ethylene-5-sulfo-isophthalate), copoly(propylene-terephthalate)-copoly(propylene-5-sulfo-isophthalate), copoly(diethylene-terephthalate)-copoly(diethylene-5-sulfoisophthalate), copoly(propylene-diethylene-terephthalate)-copoly(propylene-diethylene-5-sulfoisophthalate), copoly(propylene-butylene-terephthalate)-copoly(propylene-butylene-5-sulfo-isophthalate), copoly(propoxylated bisphenol-A-fumarate)-copoly(propoxylated bisphenol A-5-sulfoisophthalate), copoly(ethoxylated bisphenol-A-fumarate)-copoly(ethoxylated bisphenol-A-5-sulfo-isophthalate), and copoly(ethoxylated bisphenol-A-maleate)-copoly(ethoxylated bisphenol-A-5-sulfo-isophthalate), wherein the alkali metal is, for example, a sodium, lithium or potassium ion.

In embodiments, as noted above, an unsaturated amorphous polyester resin may be utilized as a latex resin. Examples of such resins include those disclosed in U.S. Pat. No. 6,063,827, the disclosure of which is hereby incorporated by reference in its entirety. Exemplary unsaturated amorphous polyester resins include, but are not limited to, poly (propoxylated bisphenol co-fumarate), poly(ethoxylated bisphenol co-fumarate), poly(butyloxylated bisphenol co-fumarate), poly(co-propoxylated bisphenol co-ethoxylated bisphenol co-fumarate), poly(1,2-propylene fumarate), poly (propoxylated bisphenol co-maleate), poly(ethoxylated bisphenol co-maleate), poly(butyloxylated bisphenol co-maleate), poly(co-propoxylated bisphenol co-ethoxylated bisphenol co-maleate), poly(1,2-propylene maleate), poly (propoxylated bisphenol co-itaconate), poly(ethoxylated bisphenol co-itaconate), poly(butyloxylated bisphenol co-itaconate), poly(co-propoxylated bisphenol co-ethoxylated bisphenol co-itaconate), poly(1,2-propylene itaconate), and combinations thereof.

Furthermore, in embodiments, a crystalline polyester resin may be contained in the binding resin. The crystalline polyester resin may be synthesized from an acid (dicarboxylic acid) component and an alcohol (diol) component. In what follows, an "acid-derived component" indicates a constituent moiety that was originally an acid component before the synthesis of a polyester resin and an "alcohol-derived component" indicates a constituent moiety that was originally an alcoholic component before the synthesis of the polyester resin.

A "crystalline polyester resin" indicates one that shows not a stepwise endothermic amount variation but a clear endothermic peak in differential scanning calorimetry (DSC). However, a polymer obtained by copolymerizing the crystalline polyester main chain and at least one other component is also called a crystalline polyester if the amount of the other component is 50% by weight or less.

As the acid-derived component, an aliphatic dicarboxylic acid may be utilized, such as a straight chain carboxylic acid. Examples of straight chain carboxylic acids include oxalic acid, malonic acid, succinic acid, glutaric acid, adipic acid, pimelic acid, suberic acid, azelaic acid, sebacic acid, 1,9-nonanedicarboxylic acid, 1,10-decanedicarboxylic acid, 1,1-undecanedicarboxylic acid, 1,12-dodecanedicarboxylic acid, 1,13-tridecanedicarboxylic acid, 1,14-tetradecanedicarboxylic acid, 1,16-hexadecanedicarboxylic acid, and 1,18-octadecanedicarboxylic acid, as well as lower alkyl esters and acid anhydrides thereof. Among these, acids having 6 to 10 carbon atoms may be desirable for obtaining suitable crystal melting point and charging properties. In order to improve the crystallinity, the straight chain carboxylic acid may be present in an amount of about 95% by mole or more of the acid component and, in embodiments, more than about 98% by mole of the acid component. Other acids are not particularly restricted, and examples thereof include conventionally known divalent carboxylic acids and dihydric alcohols, for example those described in "Polymer Data Handbook: Basic Edition" (Soc. Polymer Science, Japan Ed.: Baihukan). Specific examples of the monomer components include, as divalent carboxylic acids, dibasic acids such as phthalic acid, isophthalic acid, terephthalic acid, naphthalene-2,6-dicarboxylic acid, naphthalene-2,7-dicarboxylic acid, and cyclohexanedicarboxylic acid, and anhydrides and lower alkyl esters thereof, as well as combinations thereof, and the like. As the acid-derived component, a component such as a dicarboxylic acid-derived component having a sulfonic acid group may also be utilized. The dicarboxylic acid having a sulfonic acid group may be effective for obtaining excellent dispersion of a coloring agent such as a pigment. Furthermore, when a whole resin is emulsified or suspended in water to prepare a toner mother particle, a sulfonic acid group, may enable the resin to be emulsified or suspended without a surfactant. Examples of such dicarboxylic acids having a sulfonic group include, but are not limited to, sodium 2-sulfoterephthalate, sodium 5-sulfoisophthalate and sodium sulfosuccinate. Furthermore, lower alkyl esters and acid anhydrides of such dicarboxylic acids having a sulfonic group, for example, are also usable. Among these, sodium 5-sulfoisophthalate and the like may be desirable in view of the cost. The content of the dicarboxylic acid having a sulfonic acid group may be from about 0.1% by mole to about 2% by mole, in embodiments from about 0.2% by mole to about 1% by mole. When the content is more than about 2% by mole, the charging properties may be deteriorated. Here, "component mol %" or "component mole %" indicates the percentage when the total amount of each of the components (acid-derived component and alcohol-derived component) in the polyester resin is assumed to be 1 unit (mole).

As the alcohol component, aliphatic dialcohols may be used. Examples thereof include ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-dodecanediol, 1,12-undecanediol, 1,13-tridecanediol, 1,14-tetradecanediol, 1,18-octadecanediol and 1,20-eicosanediol. Among them, those having from about 6 to about 10 carbon atoms may be used to obtain desirable crystal melting points and charging properties. In order to raise crystallinity, it may be useful to use the straight chain dialcohols in an amount of about 95% by mole or more, in embodiments about 98% by mole or more.

Examples of other dihydric dialcohols which may be utilized include bisphenol A, hydrogenated bisphenol A, bisphenol A ethylene oxide adduct, bisphenol A propylene oxide adduct, 1,4-cyclohexanediol, 1,4-cyclohexanedimethanol, diethylene glycol, propylene glycol, dipropylene glycol, 1,3-butanediol, neopentyl glycol, combinations thereof, and the like.

For adjusting the acid number and hydroxyl number, the following may be used: monovalent acids such as acetic acid and benzoic acid; monohydric alcohols such as cyclohexanol and benzyl alcohol; benzenetricarboxylic acid, naphthalenetricarboxylic acid, and anhydrides and lower alkylesters thereof; trivalent alcohols such as glycerin, trimethylolethane, trimethylolpropane, pentaerythritol, combinations thereof, and the like.

The crystalline polyester resins may be synthesized from a combination of components selected from the above-mentioned monomer components, by using conventional known methods. Exemplary methods include the ester exchange method and the direct polycondensation method, which may be used singularly or in a combination thereof. The molar ratio (acid component/alcohol component) when the acid component and alcohol component are reacted, may vary depending on the reaction conditions. The molar ratio is usually about 1/1 in direct polycondensation. In the ester exchange method, a monomer such as ethylene glycol, neopentyl glycol or cyclohexanedimethanol, which may be distilled away under vacuum, may be used in excess.

Any suitable surfactants may be used for the preparation of the latex and wax dispersions according to the present disclosure. Depending on the emulsion system, any desired nonionic or ionic surfactant such as anionic or cationic surfactant may be contemplated.

Examples of suitable anionic surfactants include, but are not limited to, sodium dodecylsulfate, sodium dodecylbenzene sulfonate, sodium dodecylnaphthalenesulfate, dialkyl benzenealkyl sulfates and sulfonates, abitic acid, NEOGEN R® and NEOGEN SC® available from Kao, Tayca Power®, available from Tayca Corp., DOWFAX®, available from Dow Chemical Co., and the like, as well as mixtures thereof. Anionic surfactants may be employed in any desired or effective amount, for example, at least about 0.01% by weight of total monomers used to prepare the latex polymer, at least about 0.1% by weight of total monomers used to prepare the latex polymer; and no more than about 10% by weight of total monomers used to prepare the latex polymer, no more than about 5% by weight of total monomers used to prepare the latex polymer, although the amount can be outside of those ranges.

Examples of suitable cationic surfactants include, but are not limited to, dialkyl benzenealkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, $C_{12}$, $C_{15}$ and $C_{17}$ trimethyl ammonium bromides, halide salts of quaternized polyoxyethylalkylamines, dodecylbenzyl triethyl ammonium chloride. MIRAPOL® and ALKAQUAT® (available from Alkaril Chemical Company), SANIZOL® (benzalkonium chloride, available from Kao Chemicals), and the like, as well as mixtures thereof.

Examples of suitable nonionic surfactants include, but are not limited to, polyvinyl alcohol, polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxypoly(ethyleneoxy)ethanol (available from Rhone-Poulenc as IGEPAL CA-210®, IGEPAL CA-520®, IGEPAL CA-720®, IGEPAL CO-890®, IGEPAL CO-720®, IGEPAL CO-290®, IGEPAL CA-210®, ANTAROX 890®, and ANTAROX 897®) and the like, as well as mixtures thereof.

Any suitable initiator or mixture of initiators may be selected in the latex process and the toner process. In embodiments, the initiator is selected from known free radical polymerization initiators. The free radical initiator can be any free radical polymerization initiator capable of initiating a free radical polymerization process and mixtures thereof, such free radical initiator being capable of providing free radical species on heating to above about 30° C.

Although water soluble free radical initiators are used in emulsion polymerization reactions, other free radical initiators also can be used. Examples of suitable free radical initiators include, but are not limited to, peroxides, such as, ammonium persulfate, hydrogen peroxide, acetyl peroxide, cumyl peroxide, tert-butyl peroxide, propionyl peroxide, benzoyl peroxide, chlorobenzoyl peroxide, dichlorobenzoyl peroxide, bromomethylbenzoyl peroxide, lauroyl peroxide, diisopropyl peroxycarbonate, tetralin hydroperoxide, 1-phenyl-2-methylpropyl-1-hydroperoxide and tert-butylhydroperoxide; pertriphenylacetate, tert-butyl performate; tert-butyl peracetate; tert-butyl perbenzoate; tert-butyl perphenylacetate; tert-butyl permethoxyacetate; tert-butyl per-N-(3-toluyl)carbamate; sodium persulfate; potassium persulfate, azo compounds, such as, 2,2'-azobispropane, 2,2'-dichloro-2,2'-azobispropane, 1,1'-azo(methylethyl)diacetate, 2,2'-azobis(2-amidinopropane)hydrochloride, 2,2'-azobis(2-amidinopropane)-nitrate, 2,2'-azobisisobutane, 2,2'-azobisisobutylamide, 2,2'-azobisisobutyronitrile, methyl 2,2'-azobis-2-methylpropionate, 2,2'-dichloro-2,2'-azobisbutane, 2,2'-azobis-2-methylbutyronitrile, dimethyl 2,2'-azobisisobutyrate, 1,1'-azobis(sodium 1-methylbutyronitrile-3-sulfonate), 2-(4-methylphenylazo)-2-methylmalonodinitrile, 4,4'-azobis-4-cyanovaleric acid, 3,5-dihydroxymethylphenylazo-2-methylmalonodinitrile, 2-(4-bromophenylazo)-2-allylmalonodinitrile, 2,2'-azobis-2-methylvaleronitrile, dimethyl 4,4'-azobis-4-cyanovalerate, 2,2'-azobis-2,4-dimethylvaleronitrile, 1,1'-azobiscyclohexanenitrile, 2,2'-azobis-2-propylbutyronitrile, 1,1'-azobis-1-chlorophenylethane, 1,1'-azobis-1-cyclohexanecarbonitrile, 1,1'-azobis-1-cycloheptanenitrile, 1,1'-azobis-1-phenylethane, 1,1'-azobiscumene, ethyl 4-nitrophenylazobenzylcyanoacetate, phenylazodiphenylmethane, phenylazotriphenylmethane, 4-nitrophenylazotriphenylmethane, 1'-azobis-1,2-diphenylethane, poly(bisphenol A-4,4'-azobis-4-cyanopentano-ate) and poly(tetraethylene glycol-2,2'-azobisisobutyrate); 1,4-bis(pentaethylene)-2-tetrazene; 1,4-dimethoxycarbonyl1,4-dipheny-1-2-tetrazene and the like; and mixtures thereof.

More typical free radical initiators include, but are not limited to, ammonium persulfate, hydrogen peroxide, acetyl peroxide, cumyl peroxide, tert-butyl peroxide, propionyl peroxide, benzoyl peroxide, chlorobenzoyl peroxide, dichlorobenzoyl peroxide, bromomethylbenzoyl peroxide, lauroyl peroxide, sodium persulfate, potassium persulfate, diisopropyl peroxycarbonate and the like.

Based on total weight of the monomers to be polymerized, the initiator may be present in an amount from about 0.1% to about 5%, from about 0.4% to about 4%, from about 0.5% to about 3%, although may be present in greater or lesser amounts.

A chain transfer agent optionally may be used to control the polymerization degree of the latex, and thereby control the molecular weight and molecular weight distribution of the product latexes of the latex process and/or the toner process according to the present disclosure. As can be appreciated, a chain transfer agent can become part of the latex polymer.

In embodiments, the chain transfer agent has a carbon-sulfur covalent bond. The carbon-sulfur covalent bond has an absorption peak in a wave number region ranging from 500 to 800 $cm^{-1}$ in an infrared absorption spectrum. When the chain transfer agent is incorporated into the latex and the toner made from the latex, the absorption peak may be changed, for example, to a wave number region of 400 to 4,000 $cm^{-1}$.

Exemplary chain transfer agents include, but are not limited to, n-$C_{3-15}$ alkylmercaptans, such as, n-propylmercaptan, n-butylmercaptan, n-amylmercaptan, n-hexylmercaptan, n-heptylmercaptan, n-octylmercaptan, n-nonylmercaptan, n-decylmercaptan and n-dodecylmercaptan; branched alkylmercaptans, such as, isopropylmercaptan, isobutylmercaptan, s-butylmercaptan, tert-butylmercaptan, cyclohexylmercaptan, tert-hexadecylmercaptan, tert-laurylmercaptan, tert-nonylmercaptan, tert-octylmercaptan and tert-tetradecylmercaptan; aromatic ring-containing mercaptans, such as, allylmercaptan, 3-phenylpropylmercaptan, phenylmercaptan and mercaptotriphenylmethane; and so on. The terms, mercaptan and thiol may be used interchangeably to mean C—SH group.

Examples of such chain transfer agents also include, but are not limited to, dodecanethiol, butanethiol, isooctyl-3-mercaptopropionate, 2-methyl-5-t-butyl-thiophenol, carbon tetrachloride, carbon tetrabromide and the like.

Based on total weight of the monomers to be polymerized, the chain transfer agent may be present in an amount from about 0.1% to about 7%, from about 0.5% to about 6%, from about 1.0% to about 5%, although may be present in greater or lesser amounts.

In embodiments, a branching agent optionally may be included in the first/second monomer composition to control the branching structure of the target latex. Exemplary branching agents include, but are not limited to, decanediol diacrylate (ADOD), trimethylolpropane, pentaerythritol, trimellitic acid, pyromellitic acid and mixtures thereof.

Based on total weight of the monomers to be polymerized, the branching agent may be present in an amount from about 0% to about 2%, from about 0.05% to about 1.0%, from about 0.1% to about 0.8%, although may be present in greater or lesser amounts.

In the latex process and toner process of the disclosure, emulsification may be done by any suitable process, such as, mixing at elevated temperature. For example, the emulsion mixture may be mixed in a homogenizer set at about 200 to about 400 rpm and at a temperature of from about 40° C. to about 80° C. for a period of from about 1 min to about 20 min.

Any type of reactor may be used without restriction. The reactor can include means for stirring the compositions therein, such as, an impeller. A reactor can include at least one impeller. For forming the latex and/or toner, the reactor can be operated throughout the process such that the impellers can operate at an effective mixing rate of about 10 to about 1,000 rpm.

Following completion of the monomer addition, the latex may be permitted to stabilize by maintaining the conditions for a period of time, for example for about 10 to about 300 min, before cooling. Optionally, the latex formed by the above process may be isolated by standard methods known in the art, for example, coagulation, dissolution and precipitation, filtering, washing, drying or the like.

The latex of the present disclosure may be selected for emulsion-aggregation-coalescence processes for forming toners, inks and developers by known methods. The latex of the present disclosure may be melt blended or otherwise mixed with various toner ingredients, such as, a wax dispersion, a coagulant, an optional silica, an optional charge enhancing additive or charge control additive, an optional surfactant, an optional emulsifier, an optional flow additive and the like. Optionally, the latex (e.g. around 40% solids) may be diluted to the desired solids loading (e.g. about 12 to about 15% by weight solids), before formulated in a toner composition.

Based on the total toner weight, the latex may be present in an amount from about 50% to about 100%, from about 60% to about 98%, from about 70% to about 95%, although may be present in greater or lesser amounts. Methods of producing such latex resins may be carried out as described in the disclosure of U.S. Pat. No. 7,524,602, herein incorporated by reference in entirety.

Colorants

Various known suitable colorants, such as dyes, pigments, mixtures of dyes, mixtures of pigments, mixtures of dyes and pigments and the like may be included in the toner. The colorant may be included in the toner in an amount of, for example, about 0.1 to about 35% by weight of the toner, from about 1 to about 15% percent of the toner, from about 3 to about 10% by weight of the toner, although amounts outside those ranges may be utilized.

As examples of suitable colorants, mention may be made of carbon black like REGAL 330®; magnetites, such as, Mobay magnetites MO8029™ and MO8060™; Columbian magnetites; MAPICO BLACKS™, surface-treated magnetites; Pfizer magnetites CB4799™, CB5300™, CB5600™ and MCX6369™; Bayer magnetites, BAYFERROX 8600™ and 8610 ™; Northern Pigments magnetites, NP604™ and NP608™; Magnox magnetites TMB-100™ or TMB-104™; and the like. As colored pigments, there can be selected cyan, magenta, yellow, red, green, brown, blue or mixtures thereof. Generally, cyan, magenta or yellow pigments or dyes, or mixtures thereof, are used. The pigment or pigments can be water-based pigment dispersions.

Specific examples of pigments include SUNSPERSE 6000, FLEXIVERSE and AQUATONE water-based pigment dispersions from SUN Chemicals, HELIOGEN BLUE L6900™, D6840™, D7080™, D7020™, PYLAM OIL BLUE™, PYLAM OIL YELLOW™, PIGMENT BLUE 1™ available from Paul Uhlich & Company, Inc., PIGMENT VIOLET 1™, PIGMENT RED 48™, LEMON CHROME YELLOW DCC 1026™, E.D. TOLUIDINE RED™ and BON RED C™ available from Dominion Color Corporation, Ltd., Toronto, Ontario, NOVAPERM YELLOW FGL™, HOSTAPERM PINK E™ from Hoechst, CINQUASIA MAGENTA™ available from E.I. DuPont de Nemours & Company and the like. Colorants that can be selected are black, cyan, magenta, yellow and mixtures thereof. Examples of magentas are 2,9-dimethyl-substituted quinacridone and anthraquinone dye identified in the Color Index as CI 60710, CI Dispersed Red 15, diazo dye identified in the Color Index as CI 26050, CI Solvent Red 19 and the like. Illustrative examples of cyans include copper tetra(octadecyl sulfonamido) phthalocyanine, x-copper phthalocyanine pigment listed in the Color Index as CI 74160, CI Pigment Blue, Pigment Blue 15:3, Anthrathrene Blue, identified in the Color Index as CI 69810, Special Blue X-2137 and the like. Illustrative examples of yellows are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33 2,5-dimethoxy-4-sulfonanilide phenylazo-4'-chloro-2,5-dimethoxy acetoacetanilide and Permanent Yellow FGL. Colored magnetites, such as, mixtures of MAPICO BLACK™, and cyan components also may be selected as colorants. Other known colorants can be selected, such as, Levanyl Black A-SF (Miles, Bayer) and Sunsperse Carbon Black LHD 9303 (Sun Chemicals), and colored dyes, such as, Neopen Blue (BASF), Sudan Blue OS (BASF), PV Fast Blue B2G01 (American Hoechst), Sunsperse Blue BHD 6000 (Sun Chemicals), Irgalite Blue BCA (Ciba-Geigy), Paliogen Blue 6470 (BASF), Sudan III (Matheson, Coleman, Bell), Sudan II (Matheson, Coleman, Bell), Sudan IV (Matheson, Coleman, Bell), Sudan Orange G (Aldrich), Sudan Orange 220 (BASF), Paliogen Orange 3040 (BASF), Ortho Orange OR 2673 (Paul Uhlich), Paliogen Yellow 152, 1560 (BASF), Lithol Fast Yellow 0991K (BASF), Paliotol Yellow 1840 (BASF), Neopen Yellow (BASF), Novoperm Yellow FG 1 (Hoechst), Permanent Yellow YE 0305 (Paul Uhlich), Lumogen Yellow D0790 (BASF), Sunsperse Yellow YHD 6001 (Sun Chemicals), Suco-Gelb L1250 (BASF), Suco-Yellow D1355 (BASF), Hostaperm Pink E (American Hoechst), Fanal Pink D4830 (BASF), Cinquasia Magenta (DuPont), Lithol Scarlet D3700 (BASF), Toluidine Red (Aldrich), Scarlet for Thermoplast NSD PS PA (Ugine Kuhlmann of Canada), E.D. Toluidine Red (Aldrich), Lithol Rubine Toner (Paul Uhlich), Lithol Scarlet 4440 (BASF), Bon Red C (Dominion Color Company), Royal Brilliant Red RD-8192 (Paul Uhlich), Oracet Pink RF (Ciba-Geigy), Paliogen Red 3871K (BASF), Paliogen Red 3340 (BASF), Lithol Fast Scarlet L4300 (BASF), combinations of the foregoing and the like.

Wax

In addition to the polymer resin, the toners of the present disclosure also may contain a wax, which can be either a single type of wax or a mixture of two or more different waxes. A single wax can be added to toner formulations, for example, to improve particular toner properties, such as, toner particle shape, presence and amount of wax on the toner particle surface, charging and/or fusing characteristics, gloss, stripping, offset properties and the like. Alternatively, a combination of waxes can be added to provide multiple properties to the toner composition.

When included, the wax may be present in an amount of, for example, from about 1 wt % to about 25 wt % of the toner particles, in embodiments, from about 5 wt % to about 20 wt % of the toner particles.

Waxes that may be selected include waxes having, for example, a weight average molecular weight of from about 500 to about 20,000, in embodiments from about 1,000 to about 10,000. Waxes that may be used include, for example, polyolefins, such as, polyethylene, polypropylene and polybutene waxes, such as, commercially available from Allied Chemical and Petrolite Corporation, for example POLYWAX™ polyethylene waxes from Baker Petrolite, wax emulsions available from Michaelman, Inc. and the Daniels Products Company, EPOLENE N-15™ commercially available from Eastman Chemical Products, Inc., and VISCOL 550-μ™, a low weight average molecular weight polypropylene available from Sanyo Kasei K. K.; plant-based waxes, such as, carnauba wax, rice wax, candelilla wax, sumacs wax and jojoba oil; animal-based waxes, such as, beeswax; mineral-based waxes and petroleum-based waxes, such as, montan wax, ozokerite, ceresin, paraffin wax, microcrystalline wax and Fischer-Tropsch wax; ester waxes obtained from higher fatty acid and higher alcohol, such as, stearyl stearate and behenyl behenate; ester waxes obtained from higher fatty acid and monovalent or multivalent lower alcohol, such as, butyl stearate, propyl oleate, glyceride monostearate, glyceride distearate, pentaerythritol tetra behenate; ester waxes obtained from higher fatty acid and multivalent alcohol multimers, such as, diethyleneglycol monostearate, dipropyleneglycol distearate, diglyceryl distearate and triglyceryl tetrastearate; sorbitan higher fatty acid ester waxes, such as, sorbitan monostearate, and cholesterol higher fatty acid ester waxes, such as, cholesteryl stearate. Examples of functionalized waxes that may be used include, for example, amines, amides, for example, AQUA SUPERSLIP 6550™ and SUPERSLIP 6530™ available from Micro Powder Inc., fluorinated waxes, for example, POLYFLUO 190™, POLYFLUO 200™, POLYSILK 19™ and POLYSILK 14™ available from Micro Powder Inc., mixed fluorinated, amide waxes, for example, MICROSPERSION 19™ available from Micro Powder Inc., imides, esters, quaternary amines, carboxylic acids or acrylic polymer emulsion, for example JONCRYL 74™, 89™, 130™, 537™ and 538™, all available from SC Johnson Wax, and chlorinated polypropylenes and polyethylenes available from Allied Chemical and Petrolite Corporation and SC Johnson wax. Mixtures and combinations of the foregoing waxes also may be used in embodiments. Waxes may be included as, for example, fuser roll release agents.

Toner Preparation

The toner particles may be prepared by any method within the purview of one skilled in the art. Although embodiments relating to toner particle production are described below with respect to emulsion-aggregation processes, any suitable method of preparing toner particles may be used, including chemical processes, such as suspension and encapsulation processes disclosed in U.S. Pat. Nos. 5,290,654 and 5,302,486, the disclosure of each of which hereby is incorporated by reference in entirety. In embodiments, toner compositions and toner particles may be prepared by aggregation and coalescence processes in which smaller-sized resin particles are aggregated to the appropriate toner particle size and then coalesced to achieve the final toner particle shape and morphology.

In embodiments, toner compositions may be prepared by emulsion-aggregation processes, such as, a process that includes aggregating a mixture of an optional wax and any other desired or required additives, and emulsions including the resins described above, optionally with surfactants, as described above, and then coalescing the aggregate mixture. A mixture may be prepared by adding an optional wax or other materials, which optionally also may be in a dispersion(s) including a surfactant, to the emulsion, which may be a mixture of two or more emulsions containing the resin. The pH of the resulting mixture may be adjusted by an acid (i.e., a pH adjustor) such as, for example, acetic acid, nitric acid or the like. In embodiments, the pH of the mixture may be adjusted to from about 2 to about 4.5. Additionally, in embodiments, the mixture may be homogenized. If the mixture is homogenized, homogenization may be accomplished by mixing at about 600 to about 4,000 revolutions per minute (rpm). Homogenization may be accomplished by any suitable means, including, for example, with an IKA ULTRA TURRAX T50 probe homogenizer.

Following preparation of the above mixture, an aggregating agent may be added to the mixture. Suitable aggregating agents include, for example, aqueous solutions of a divalent cation or a multivalent cation material. The aggregating agent may be, for example, polyaluminum halides, such as, polyaluminum chloride (PAC), or the corresponding bromide, fluoride or iodide, polyaluminum silicates, such as, polyaluminum sulfosilicate (PASS), and water soluble metal salts including aluminum chloride, aluminum nitrite, aluminum sulfate, potassium aluminum sulfate, calcium acetate, calcium chloride, calcium nitrite, calcium oxylate, calcium sulfate, magnesium acetate, magnesium nitrate, magnesium sulfate, zinc acetate, zinc nitrate, zinc sulfate, zinc chloride, zinc bromide, magnesium bromide, copper chloride, copper sulfate, and combinations thereof. In embodiments, the aggregating agent may be added to the mixture at a temperature that is below the glass transition temperature ($T_g$) of the resin.

The aggregating agent may be added to the mixture to form a toner in an amount of, for example, from about 0.1 parts per hundred (pph) to about 1 pph, in embodiments, from about 0.25 pph to about 0.75 pph.

The gloss of a toner may be influenced by the amount of retained metal ion, such as, $Al^{3+}$, in the particle. The amount of retained metal ion may be adjusted further by the addition of ethylene diamine tetraacetic acid (EDTA). In embodiments, the amount of retained metal ion, for example, $Al^{3+}$, in toner particles of the present disclosure may be from about 0.1 pph to about 1 pph, in embodiments, from about 0.25 pph to about 0.8 pph.

The disclosure also provides a melt mixing process to produce low cost and safe cross-linked thermoplastic binder resins for toner compositions which have, for example, low fix temperature and/or high offset temperature, and which may show minimized or substantially no vinyl offset. In the process, unsaturated base polyester resins or polymers are melt blended, that is, in the molten state under high shear conditions producing substantially uniformly dispersed toner constituents, and which process provides a resin blend and toner product with optimized gloss properties (see, e.g., U.S. Pat. No. 5,556,732, herein incorporated by reference in entirety). By, "highly cross-linked," is meant that the polymer involved is substantially cross-linked, that is, equal to or above the gel point. As used herein, "gel point," means the point where the polymer is no longer soluble in solution (see, e.g., U.S. Pat. No. 4,457,998, herein incorporated by reference in entirety).

To control aggregation and coalescence of the particles, in embodiments, the aggregating agent may be metered into the mixture over time. For example, the agent may be metered into the mixture over a period of from about 5 to about 240 min, in embodiments, from about 30 to about 200 min. Addition of the agent may also be done while the mixture is maintained under stirred conditions, in embodiments from about 50 rpm to about 1,000 rpm, in embodiments, from about 100 rpm to about 500 rpm, and at a temperature that is below the $T_g$ of the resin.

The particles may be permitted to aggregate until a predetermined desired particle size is obtained. A predetermined desired size refers to the desired particle size as determined prior to formation, with particle size monitored during the growth process as known in the art until such particle size is achieved. Samples may be taken during the growth process and analyzed, for example with a Coulter Counter, for average particle size. The aggregation thus may proceed by maintaining the elevated temperature, or slowly raising the temperature to, for example, from about 40° C. to about 100° C., and holding the mixture at that temperature for a time from about 0.5 hr to about 6 hr, in embodiments, from about 1 hr to about 5 hr, while maintaining stirring, to provide the aggregated particles. Once the predetermined desired particle size is obtained, the growth process is halted. In embodiments, the predetermined desired particle size is within the toner particle size ranges mentioned above. In embodiments, the particle size may be about 5.0 to about 6.0 μm, about 6.0 to about 6.5 μm, about 6.5 to about 7.0 μm, about 7.0 to about 7.5 μm.

Growth and shaping of the particles following addition of the aggregation agent may be accomplished under any suitable conditions. For example, the growth and shaping may be conducted under conditions in which aggregation occurs separate from coalescence. For separate aggregation and coalescence stages, the aggregation process may be conducted under shearing conditions at an elevated temperature, for example from about 40° C. to about 90° C., in embodiments, from about 45° C. to about 80° C., which may be below the $T_g$ of the resin.

Toners may possess favorable charging characteristics when exposed to extreme RH conditions. The low humidity zone (C zone) may be about 12° C./15% RH, while the high humidity zone (A zone) may be about 28° C./85% RH. Toners of the disclosure may possess a parent toner charge per mass ratio (Q/M) of from about −5 μC/g to about −80 μC/g, in embodiments, from about −10 μC/g to about −70 μC/g, and a final toner charging after surface additive blending of from −15 μC/g to about −60 μC/g, in embodiments, from about −20 μC/g to about −55 μC/g.

Shell Resin

In embodiments, a shell may be applied to the formed aggregated toner particles. Any resin described above as suitable for the core resin may be utilized as the shell resin. The shell resin may be applied to the aggregated particles by any method within the purview of those skilled in the art. In embodiments, the shell resin may be in an emulsion including any surfactant described herein. The aggregated particles described above may be combined with said emulsion so that the resin forms a shell over the formed aggregates. In embodiments, an amorphous polyester may be utilized to form a shell over the aggregates to form toner particles having a core-shell configuration.

Toner particles can have a size of diameter of from about 4 to about 8 μm, in embodiments, from about 5 to about 7 μm, the optimal shell component may be about 26 to about 30% by weight of the toner particles.

Alternatively, a thicker shell may be desirable to provide desirable charging characteristics due to the higher surface area of the toner particle. Thus, the shell resin may be present in an amount from about 30% to about 40% by weight of the toner particles, in embodiments, from about 32% to about 38% by weight of the toner particles, in embodiments, from about 34% to about 36% by weight of the toner particles.

In embodiments, a photoinitiator may be included in the shell. Thus, the photoinitiator may be in the core, the shell, or both. The photoinitiator may be present in an amount of from about 1% to about 5% by weight of the toner particles, in embodiments, from about 2% to about 4% by weight of the toner particles.

Emulsions may have a solids loading of from about 5% solids by weight to about 20% solids by weight, in embodiments, from about 12% solids by weight to about 17% solids by weight.

Once the desired final size of the toner particles is achieved, the pH of the mixture may be adjusted with a base (i.e., a pH adjustor) to a value of from about 6 to about 10, and in embodiments from about 6.2 to about 7. The adjustment of the pH may be utilized to freeze, that is to stop, toner growth. The base utilized to stop toner growth may include any suitable base, such as, for example, alkali metal hydroxides, such as, for example, sodium hydroxide, potassium hydroxide, ammonium hydroxide, combinations thereof and the like. In embodiments, EDTA may be added to help adjust the pH to the desired values noted above. The base may be added in amounts from about 2 to about 25% by weight of the mixture, in embodiments, from about 4 to about 10% by weight of the mixture. In embodiments, the shell has a higher $T_g$ than the aggregated toner particles.

Coalescence

Following aggregation to the desired particle size, with the optional formation of a shell as described above, the particles then may be coalesced to the desired final shape, the coalescence being achieved by, for example, heating the mixture to a temperature of from about 55° C. to about 100° C., in embodiments from about 65° C. to about 75° C., which may be below the melting point of a crystalline resin to prevent plasticization. Higher or lower temperatures may be used, it being understood that the temperature is a function of the resins used.

Coalescence may proceed over a period of from about 0.1 to about 9 hr, in embodiments, from about 0.5 to about 4 hr.

After coalescence, the mixture may be cooled to room temperature, such as from about 20° C. to about 25° C. The cooling may be rapid or slow, as desired. A suitable cooling method may include introducing cold water to a jacket around the reactor. After cooling, the toner particles optionally may be washed with water and then dried. Drying may be accomplished by any suitable method, for example, freeze drying.

Additives

Toner particles also may contain other optional additives, as desired or required. For example, the toner may include any known charge additives in amounts of from about 0.1 to about 10 wt %, in embodiments of from about 0.5 to about 7 wt % of the toner. Examples of such charge additives include alkyl pyridinium halides, bisulfates, the charge control additives of U.S. Pat. Nos. 3,944,493, 4,007,293, 4,079,014, 4,394,430 and 4,560,635, the disclosure of each of which hereby is incorporated by reference in entirety, negative charge enhancing additives like aluminum complexes, and the like.

Surface additives can be added to the toner compositions after washing or drying. Examples of such surface additives include, for example, metal salts, metal salts of fatty acids, colloidal silicas, metal oxides, strontium titanates, mixtures thereof and the like. Surface additives may be present in an amount of from about 0.1 to about 10 wt %, in embodiments of from about 0.5 to about 7 wt % of the toner. Examples of such additives include those disclosed in U.S. Pat. Nos. 3,590,000, 3,720,617, 3,655,374 and 3,983,045, the disclosure of each of which hereby is incorporated by reference in entirety. Other additives include zinc stearate and AEROSIL R972® available from Degussa. The coated silicas of U.S. Pat. Nos. 6,190,815 and 6,004,714, the disclosure of each of which hereby is incorporated by reference in entirety, also can be present in an amount of from about 0.05 to about 5%, in embodiments, of from about 0.1 to about 2% of the toner, which additives can be added during the aggregation or blended into the formed toner product.

The characteristics of the toner particles may be determined by any suitable technique and apparatus. Volume average particle diameter $D_{50v}$, $GSD_v$ and $GSD_n$ may be measured by means of a measuring instrument, such as, a Beckman Coulter Multisizer 3, operated as recommended by the manufacturer. Toners may possess favorable charging characteristics when exposed to extreme RH conditions.

Utilizing the methods of the present disclosure, desirable gloss levels may be obtained. Thus, for example, the gloss level of a toner may have a gloss, as measured in Gardner Gloss Units (ggu) of from about 20 ggu to about 100 ggu, in embodiments, from about 50 ggu to about 95 ggu, in embodiments, from about 60 ggu to about 90 ggu. In embodiments, the gloss level is from about 80 to about 100 ggu.

In embodiments, toners of the present disclosure may be utilized as ultra low melt (ULM) toners. In embodiments, the dry toner particles, exclusive of external surface additives, may have the following characteristics:

(1) circularity of from about 0.9 to about 1 (measured with, for example, a Sysmex 3000 analyzer), in embodiments from about 0.95 to about 0.99, in embodiments, from about 0.96 to about 0.98;

(2) $T_g$ of from about 45° C. to about 60° C., in embodiments from about 48° C. to about 55° C.; and/or (3) melt flow index (FI) in g/10 min (5 kg/130° C.) of from about 79.0 to about 172.5.

Carriers

Various suitable solid core or particle materials can be utilized for the carriers and developers of the present disclosure. Characteristic particle properties include those that, in embodiments, will enable the toner particles to acquire a positive charge or a negative charge, and carrier cores that provide desirable flow properties in the developer reservoir present in an electrophotographic imaging apparatus. Other desirable properties of the core include, for example, suitable magnetic characteristics that permit magnetic brush formation in magnetic brush development processes; desirable mechanical aging characteristics; and desirable surface morphology to permit high electrical conductivity of any developer including the carrier and a suitable toner.

Examples of carrier particles or cores that can be utilized include iron and/or steel, such as, atomized iron or steel powders available from Hoeganaes Corporation or Pomaton S.p.A (Italy); ferrites, such as, Cu/Zn-ferrite containing, for example, about 11% copper oxide, about 19% zinc oxide, and about 70%© iron oxide, including those commercially available from D.M. Steward Corporation or Powdertech Corporation, Ni/Zn-ferrite available from Powdertech Corporation, Sr (strontium)-ferrite, containing, for example, about 14% strontium oxide and about 86% iron oxide, commercially available from Powdertech Corporation, and Ba-ferrite; magnetites, including those commercially available from, for example, Hoeganaes Corporation (Sweden); nickel; combinations thereof, and the like. In embodiments, the polymer particles obtained can be used to coat carrier cores of any known type by various known methods, and which carriers then are incorporated with a known toner to form a developer for electrophotographic printing. Other suitable carrier cores are illustrated in, for example, U.S. Pat. Nos. 4,937,166, 4,935,326 and 7,014,971, the disclosure of each of which hereby is incorporated by reference in entirety, and may include granular zircon, granular silicon, glass, silicon dioxide, combinations thereof, and the like. In embodiments, suitable carrier cores may have an average particle size of, for example, from about 20 μm to about 400 μm in diameter, in embodiments, from about 40 μm to about 200 μm in diameter.

In embodiments, a ferrite may be utilized as the core, including a metal, such as, iron and at least one additional metal, such as, copper, zinc, nickel, manganese, magnesium, calcium, lithium, strontium, zirconium, titanium, tantalum, bismuth, sodium, potassium, rubidium, cesium, strontium, barium, yttrium, lanthanum, hafnium, vanadium, niobium, aluminum, gallium, silicon, germanium, antimony, combinations thereof and the like.

The polymeric coating on the core metal includes a polymer resin that contains at least one ester functional group and at least one cyclic aliphatic group containing at least one nitrogen atom in the cyclic ring structure. Suitable polymers with an ester functional group are acrylates and methacrylates, while suitable aliphatic cyclic groups containing nitrogen include an N-alkyl piperidinyl moiety, rings containing an amide moiety with a tertiary N, and rings containing a nitroxyl moiety. In the present embodiments, the ring structure can be of various sizes, such as form example, a ring having from about four to about ten carbon atoms, or from about four to about eight carbon atoms, or from about five to about six carbon atoms. The nitrogen may be located in any position in the ring, such as for example, ortho, para or meta positions. The following methacrylates are illustrative examples:

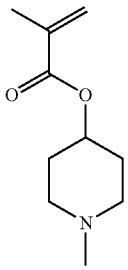

1-methylpiperidin-4-yl MA
(4MPMA)

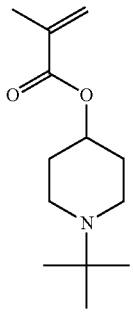

1-t-butylpiperidin-4-yl MA
(4t-ButylPMA)

-continued

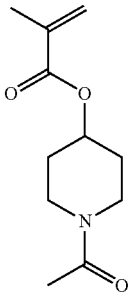

1-acetylpiperidin-4-yl
(NAc4PMA)

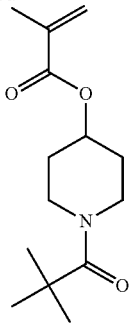

1-pivaloylpiperidin-4-yl MA
(NP4PMA)

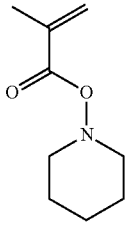

piperidin-1-yl MA
(PipMA)

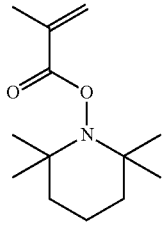

2,2,6,6-tetramethylpiperidin-1-yl
(TMPipMA)

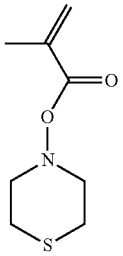

thiomorpholin-4-yl MA
(TMoMA)

In some embodiments, the polymer resin that contains at least one ester functional group and at least one cyclic aliphatic group containing at least one nitrogen atom in the cyclic ring structure has a formula of:

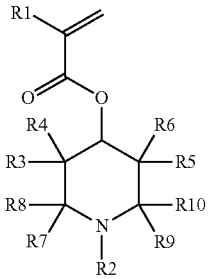

wherein R1=H, $CH_3$ and R2=$CH_3$, $CH_2CH_3$, $CH(CH_3)_2$, $C(CH_3)_3$, $N(C{=}0)CH_3$, $N(C{=}0)C(CH_3)_3$, $N(C{=}0)CH(CH_3)_2$, $N(C{=}0)CH_2CH_3$ and R3, R4, R5, R6, R7, R8, R9, R10=H, $CH_3$, $CH_2CH_3$.

In some embodiments, the polymer resin that contains at least one ester functional group and at least one cyclic aliphatic group containing at least one nitrogen atom in the cyclic ring structure has a formula of:

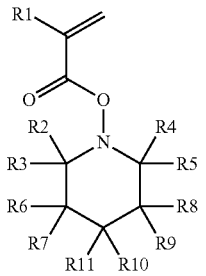

wherein R1=H, $CH_3$ and R2, R3, R4, R5, R6, R7, R8, R9, R10=H, $CH_3$, $CH_2CH_3$.

The above monomers are shown by modeling to provide outstanding positive charging characteristics and are expected to provide excellent RH sensitivity due to the high C/O ratios. In embodiments, the monomers used provide an onset Tg of from about 80 to about 200° C., or of from about 80 to about 140° C., or of from about 100 to about 120° C. In further embodiments, the monomers have a C/O ratio of greater than 4, or of from about 3 to about 10, or of from about 4 to about 8. The monomers utilized as the carrier coating may have a number average molecular weight ($M_n$), as measured by gel permeation chromatography (GPC) of, for example, from about 60,000 to about 400,000, in embodiments, from about 170,000 to about 280,000, and a weight average molecular weight ($M_w$) of, for example, from about 200,000 to about 800,000, in embodiments from about 400,000 to about 600,000, as determined by GPC.

The carrier coating of the present embodiments may include one or more of the above monomers in an amount of from about 0.05% to about 100%, or of from about 0.1% to about 40%, or of from about 0.5% to about 4% by weight of the total weight of the carrier coating. In embodiments, the carrier coating is in the form of particles with an average particle size of from about 50 nm to about 500 nm, or from about 50 to about 500 nm, or of from about 80 to about 200 nm. In embodiments, the carrier coating monomers provide a Tg onset of from about 80 to about 200° C. or of from about 80 to about 140° C., or of from about 100 to about 120° C. In further embodiments, the carrier coating has a C/O ratio of greater than 4, or of from about 3 to about 10, or of from about 4 to about 8. In embodiments, the carrier coating polymer monomer repeat unit has a gap for forward charge transfer to silica of less than 4.5 eV and a gap for reverse charge transfer from silica to the polymer monomer repeat unit of greater than 5.5 eV.

Charge control agent monomers include, but are not limited to, acidic acrylates and dialkylaminoacrylates. Suitable acidic acrylate monomers which may be utilized in forming the polymer coating include, for example, acrylic acid, methacrylic acid, β-carboxyethyl acrylate, combinations thereof and the like. Suitable dialkylaminoacrylates which may be utilized in forming the polymer coating include, for example, dimethylamino ethyl methacrylate (DMAEMA), 2-(dimethylamino) ethyl methacrylate, diethylamino ethyl methacrylate, dimethylamino butyl methacrylate, methylamino ethyl methacrylate, combinations thereof and the like.

By negative additives that are negatively chargeable to a reference carrier is meant that the additives are negatively charging relative to the toner surface measured by determining the toner triboelectric charge with and without the additives. Similarly, by positive additives that are positively chargeable to a carrier is meant that the additives are positively charging relative to the toner surface measured by determining the toner triboelectric charge with and without the additives.

Where the cycloacrylate is combined with a charge control agent monomer, the cycloacrylate may be present in a copolymer utilized as a polymeric coating of a carrier core in an amount of from about 0.1% by weight of the copolymer to about 99.8% by weight of the copolymer, in embodiments from about 50% by weight of the copolymer to about 95% by weight of the copolymer. The charge control agent monomer may be present in such a copolymer in an amount of from about 0.1% by weight of the copolymer to about 5% by weight of the copolymer.

Carrier resins with high C/O ratios, for example, the resins of the present embodiments, improve RH sensitivity while providing good charge, compared to conventional resins, for example, poly(methyl methacrylate) (PMMA).

Thus, in embodiments, A zone charge may be from about −15 to about −60 μC/g, in embodiments, from about −20 to about −55 μC/g, while C zone charge may be from about −15 to about −60 μC/g, in embodiments from about −20 to about −55 μC/g. The ratio of A zone charge to C zone charge, sometimes referred to herein, in embodiments, as the RH ratio, may be from about 0.4 to about 1.0, in embodiments from about 0.6 to about 0.8.

Methods for forming the polymeric coating are within the purview of those skilled in the art and include, in embodiments, emulsion polymerization of the monomers utilized to form the polymeric coating.

In the polymerization process, the reactants may be added to a suitable reactor, such as a mixing vessel. The appropriate amount of starting materials may be optionally dissolved in a solvent, an optional initiator may be added to the solution, and contacted with at least one surfactant to form an emulsion. A copolymer may be formed in the emulsion, which may then be recovered and used as the polymeric coating for a carrier particle.

Where utilized, suitable solvents include, but are not limited to, water and/or organic solvents including toluene, benzene, xylene, tetrahydrofuran, acetone, acetonitrile, carbon tetrachloride, chlorobenzene, cyclohexane, diethyl ether, dimethyl ether, dimethyl formamide, heptane, hexane, methylene chloride, pentane, combinations thereof, and the like.

In embodiments, the latex for forming the polymeric coating may be prepared in an aqueous phase containing a surfactant or co-surfactant, optionally under an inert gas such as nitrogen. Surfactants which may be utilized with the resin to form a latex dispersion can be ionic or nonionic surfactants in an amount of from about 0.01 to about 15 wt % of the solids, in embodiments from about 0.1 to about 10 wt % of the solids.

Anionic surfactants which may be utilized include sulfates and sulfonates, sodium dodecylsulfate (SDS), sodium dodecylbenzene sulfonate, sodium dodecylnaphthalene sulfate, dialkyl benzenealkyl sulfates and sulfonates, acids such as abietic acid available from Aldrich, NEOGEN R™, NEOGEN SC™ obtained from Daiichi Kogyo Seiyaku Co., Ltd., combinations thereof, and the like. Other suitable anionic surfactants include, in embodiments, DOWFAX™ 2A1, an alkyldiphenyloxide disulfonate from The Dow Chemical Company, and/or TAYCA POWER BN2060 from Tayca Corporation (Japan), which are branched sodium dodecyl benzene sulfonates. Combinations of the surfactants and any of the foregoing anionic surfactants may be utilized in embodiments.

Examples of cationic surfactants include, but are not limited to, ammoniums, for example, alkylbenzyl dimethyl ammonium chloride, dialkyl benzenealkyl ammonium chloride, lauryl trimethyl ammonium chloride, alkylbenzyl methyl ammonium chloride, alkyl benzyl dimethyl ammonium bromide, benzalkonium chloride, $C_{12}$, $C_{15}$ or $C_{17}$ trimethyl ammonium bromides, combinations thereof, and the like. Other cationic surfactants include cetyl pyridinium bromide, halide salts of quaternized polyoxyethylalkylamines, dodecylbenzyl triethyl ammonium chloride, MIRAPOL and ALKAQUAT available from Alkaril Chemical Company, SANISOL (benzalkonium chloride), available from Kao Chemicals, combinations thereof, and the like. In embodiments a suitable cationic surfactant includes SANISOL B-50 available from Kao Corp., which is primarily a benzyl dimethyl alkonium chloride.

Examples of nonionic surfactants include, but are not limited to, alcohols, acids and ethers, for example, polyvinyl alcohol, polyacrylic acid, methalose, methyl cellulose, ethyl cellulose, propyl cellulose, hydroxyl ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxy poly(ethyleneoxy) ethanol, combinations thereof, and the like. In embodiments, commercially available surfactants from Rhone-Poulenc such as IGEPAL CA210™, IGEPAL CA520™, IGEPAL CA-720™, IGEPAL CO890™, IGEPAL CO720™, IGEPAL CO290™, IGEPAL CA-210™, ANTAROX 890™ and ANTAROX 897™ can be utilized.

The choice of particular surfactants or combinations thereof, as well as the amounts of each to be used, is within the purview of those skilled in the art.

In embodiments, initiators may be added for formation of the latex utilized in formation of the polymeric coating. Examples of suitable initiators include water soluble initiators, such as ammonium persulfate, sodium persulfate and potassium persulfate, and organic soluble initiators including organic peroxides and azo compounds including Vazo peroxides, such as VAZO 64™, 2-methyl 2-2'-azobis propanenitrile, VAZO 88™, 2-2'-azobis isobutyramide dehydrate and combinations thereof. Other water soluble initiators which may be utilized include azoamidine compounds, for example 2,2'-azobis(2-methyl-N-phenylpropionamidine)dihydrochloride, 2,2'-azobis[N-(4-chlorophenyl)-2-methylpropionamidine]di-hydrochloride, 2,2'-azobis[N-(4-hydroxyphenyl)-2-methylpropionamidine]dihydrochloride, 2,2'-azobis[N-(4-amino-phenyl)-2-methylpropionamidine] tetrahydrochloride, 2,2'-azobis[2-methyl-N(phenylmethyl) propionamidine]dihydrochloride, 2,2'-azobis[2-methyl-N-2-propenylpropionamidine]dihydrochloride, 2,2'-azobis[N-(2-hydroxy-ethyl)2-methylpropionamidine]dihydrochloride, 2,2'-azobis[2(5-methyl-2-imidazolin-2-yl)propane]dihydrochloride, 2,2'-azobis[2-(2-imidazolin-2-yl)propane]dihydrochloride, 2,2'-azobis[2-(4,5,6,7-tetrahydro-1H-1,3-diazepin-2-yl)propane]dihydrochloride, 2,2'-azobis[2-(3,4,5,6-tetrahydropyrimidin-2-yl)propane]dihydrochloride, 2,2'-azobis[2-(5-hydroxy-3,4,5,6-tetrahydropyrimidin-2-yl) propane]dihydrochloride, 2,2'-azobis[2-[1-(2-hydroxyethyl)-2-imidazolin-2-yl]propane]dihydrochloride, combinations thereof and the like.

Initiators can be added in suitable amounts, such as from about 0.1 to about 8 wt %, in embodiments, from about 0.2 to about 5 wt % of the monomers.

In forming the emulsions, the starting materials, surfactant, optional solvent and optional initiator may be combined utilizing any means within the purview of those skilled in the art. In embodiments, the reaction mixture may be mixed for from about 1 min to about 72 hr, in embodiments from about 4 hr to about 24 hr (although times outside those ranges may be utilized), while keeping the temperature at from about 10° C. to about 100° C., in embodiments, from about 20° C. to about 90° C., in embodiments, from about 45° C. to about 75° C., although temperatures outside those ranges may be utilized.

Those skilled in the art will recognize that optimization of reaction conditions, temperature, and initiator loading can be varied to generate resins of various molecular weights, and that structurally related starting materials may be polymerized using comparable techniques.

Once the polymer utilized as the coating for a carrier has been formed, the resin may be recovered from the emulsion by any technique within the purview of those skilled in the art, including filtration, drying, centrifugation, spray drying, combinations thereof and the like.

In embodiments, once obtained, the polymer utilized as the coating for a carrier may be dried to powder form by any method within the purview of those skilled in the art, including, for example, freeze drying, optionally in a vacuum, spray drying, combinations thereof and the like.

Particles of the polymer may have a size of from about 50 nm to about 500 nm, in embodiments, from about 60 nm to about 400 nms, in embodiments from about 70 nm to about 300 nm, in embodiments from about 80 nm to about 200 nm.

In embodiments, if the size of the particles of the dried polymeric coating is too large, the particles may be subjected to homogenizing or sonication to further disperse the particles and break apart any agglomerates or loosely bound particles, thereby obtaining particles of the sizes noted above. Where utilized, a homogenizer, (that is, a high shear device), may operate at a rate of from about 6,000 rpm to about 10,000 rpm, in embodiments, from about 7,000 rpm to about 9,750 rpm, for a period of time of from about 0.5 min to about 60 min, in embodiments, from about 5 min to about 30 min, although speeds and times outside those ranges may be utilized.

In some embodiments, the carrier coating may include a conductive component. Suitable conductive components include, for example, carbon black.

There may be added to the carrier a number of additives, for example, charge enhancing additives, including particulate amine resins, such as, melamine, and certain fluoropolymer powders, such as alkyl-amino acrylates and methacrylates, polyamides, and fluorinated polymers, such as polyvinylidine fluoride and poly(tetrafluoroethylene) and fluoroalkyl methacrylates, such as 2,2,2-trifluoroethyl methacrylate. Other charge enhancing additives which may be utilized include quaternary ammonium salts, including distearyl dimethyl ammonium methyl sulfate (DDAMS), bis[1-[(3,5-disubstituted-2-hydroxyphenyl)azo]-3-(mono-substituted)-2-naphthalenolato(2-)]chromate(1-), ammonium sodium and hydrogen (TRH), cetyl pyridinium chloride (CPC), FANAL PINK® D4830, combinations thereof, and the like, and other effective known charge agents or additives. The charge additive components may be selected in various effective amounts, such as from about 0.5 wt % to about 20 wt %, from about 1 wt % to about 3 wt %, based, for example, on the sum of the weights of polymer/copolymer, conductive component, and other charge additive components. The addition of conductive components can act to further increase the negative triboelectric charge imparted to the carrier, and therefore, further increase the negative triboelectric charge imparted to the toner in, for example, an electrophotographic development subsystem. The components may be included by roll mixing, tumbling, milling, shaking, electrostatic powder cloud spraying, fluidized bed, electrostatic disc processing, and an electrostatic curtain, as described, for example, in U.S.

Pat. No. 6,042,981, the disclosure of which hereby is incorporated by reference in entirety, and wherein the carrier coating is fused to the carrier core in either a rotary kiln or by passing through a heated extruder apparatus.

Conductivity can be important for semiconductive magnetic brush development to enable good development of solid areas which otherwise may be weakly developed. Addition of a polymeric coating of the present disclosure, optionally with a conductive component such as carbon black, can result in carriers with decreased developer triboelectric response with change in relative humidity of from about 20% to about 90%, in embodiments, from about 40% to about 80%, that the charge is more consistent when the relative humidity is changed. Thus, there is less decrease in charge at high relative humidity reducing background toner on the prints, and less increase in charge and subsequently less loss of development at low relative humidity, resulting in such improved image quality performance due to improved optical density.

As noted above, in embodiments the polymeric coating may be dried, after which time it may be applied to the core carrier as a dry powder. Powder coating processes differ from conventional solution coating processes. Solution coating requires a coating polymer whose composition and molecular weight properties enable the resin to be soluble in a solvent in the coating process. That requires relatively low $M_w$ components as compared to powder coating. The powder coating process does not require solvent solubility, but does require the resin coated as a particulate with a particle size of from about 10 nm to about 2 μm, in embodiments, from about 30 nm to about 1 μm, in embodiments, from about 50 nm to about 500 nm.

Examples of processes which may be utilized to apply the powder coating include, for example, combining the carrier core material and resin coating by cascade roll mixing, tumbling, milling, shaking, electrostatic powder cloud spraying, fluidized bed, electrostatic disc processing, electrostatic curtains, combinations thereof and the like. When resin coated carrier particles are prepared by a powder coating process, the majority of the coating materials may be fused to the carrier surface, thereby reducing the number of toner impaction sites on the carrier. Fusing of the polymeric coating may occur by mechanical impaction, electrostatic attraction, combinations thereof and the like.

Following application of the resin to the core, heating may be initiated to permit flow of the coating material over the surface of the carrier core. The concentration of the coating material, in embodiments, powder particles, and the parameters of the heating may be selected to enable the formation of a continuous film of the coating polymers on the surface of the carrier core, or permit only selected areas of the carrier core to be coated. In embodiments, the carrier with the polymeric powder coating may be heated to a temperature of from about 170° C. to about 280° C., in embodiments from about 190° C. to about 240° C., for a period of time of, for example, from about 10 min to about 180 min, in embodiments, from about 15 min to about 60 min, to enable the polymer coating to melt and to fuse to the carrier core particles. Following incorporation of the powder on the surface of the carrier, heating may be initiated to permit flow of the coating material over the surface of the carrier core. In embodiments, the powder may be fused to the carrier core in either a rotary kiln or by passing through a heated extruder apparatus, see, for example, U.S. Pat. No. 6,355,391, the disclosure of which hereby is incorporated by reference in entirety.

In embodiments, the coating coverage encompasses from about 10% to about 100% of the carrier core. When selected areas of the metal carrier core remain uncoated or exposed, the carrier particles may possess electrically conductive properties when the core material is a metal.

The coated carrier particles may then be cooled, in embodiments to room temperature, and recovered for use in forming developer.

In embodiments, carriers of the present disclosure may include a core, in embodiments, a ferrite core, having a size of from about 20 μm to about 100 μm, in embodiments, from about 30 μm to about 75 μm, coated with from about 0.5% to about 10% by weight, in embodiments, from about 0.7% to about 5% by weight, of the polymer coating of the present disclosure, optionally including carbon black.

Thus, with the carrier compositions and processes of the present disclosure, there can be formulated developers with selected high triboelectric charging characteristics and/or conductivity values utilizing a number of different combinations.

Developers

The toner particles thus formed may be formulated into a developer composition. The toner particles may be mixed with carrier particles to achieve a two component developer composition. The toner concentration in the developer may be from about 1% to about 25% by weight of the total weight of the developer, in embodiments, from about 2% to about 15% by weight of the total weight of the developer.

Resistivity

To measure carrier conductivity or resistivity, about 30 to about 50 g of the carrier may be placed between two circular planar parallel steel electrodes (radius of about 3 cm) and compressed by a weight of 4 kg to form an about 0.4 to about 0.5 cm layer; a DC voltage of about 10 v may be applied between the electrodes, and a DC current may be measured in series between the electrodes and voltage source after 1 minute following the moment of voltage application. Conductivity in (ohm cm) may be obtained by multiplying current in amps by the layer thickness in centimeters and dividing by the electrode area in $cm^2$ and by the voltage, 10 v. Resistivity may be obtained as the inverse of the conductivity and may be measured in ohm-cm. The voltage may be increased to 150 v and the measurement repeated using the value of the voltage of 150 v.

In accordance with the present disclosure, a carrier may have a resistivity of from about $10^9$ to about $10^{14}$ ohm-cm measured at 10 v and from about $10^8$ to about $10^{13}$ ohm-cm at 150 v.

In accordance with the present disclosure, it has been discovered that developer charging RH sensitivity can be improved by increasing the molar C/O ratio of the carrier coating resin, by using a carrier resin comprising a heterocycle comprising sulfur or both. Thus, developers of the present disclosure may have an RH sensitivity of from about 0.4 to about 1.0, in embodiments, from about 0.6 to about 0.8.

Imaging

The toners can be utilized for electrophotographic processes, including those disclosed in U.S. Pat. No. 4,295,990, the disclosure of which is hereby incorporated by reference in entirety. In embodiments, any known type of image development system may be used in an image developing device, including, for example, magnetic brush development, hybrid scavengeless development (HSD) and the like. Those and similar development systems are within the purview of those skilled in the art.

It is envisioned that the toners of the present disclosure may be used in any suitable procedure for forming an image with a toner, including in applications other than xerographic applications.

Utilizing the toners of the present disclosure, images may be formed on substrates, including flexible substrates, having a toner pile height of from about 1 μm to about 6 μm, in embodiments, from about 2 μm to about 4.5 μm, in embodiments, from about 2.5 to about 4.2 μm.

In embodiments, the toner of the present disclosure may be used for a xerographic print protective composition that provides overprint coating properties including, but not limited to, thermal and light stability and smear resistance, particularly in commercial print applications. More specifically, such overprint coating as envisioned has the ability to permit overwriting, reduce or prevent thermal cracking, improve fusing, reduce or prevent document offset, improve print performance and protect an image from sun, heat and the like. In embodiments, the overprint compositions may be used to improve the overall appearance of xerographic prints due to the ability of the compositions to fill in the roughness of xerographic substrates and toners, thereby forming a level film and enhancing glossiness.

The following Examples are submitted to illustrate embodiments of the disclosure. The Examples are intended to be illustrative only and are not intended to limit the scope of the disclosure. Also, parts and percentages are by weight unless otherwise indicated. As used herein, "room temperature," refers to a temperature of from about 20° C. to about 30° C.

EXAMPLES

The examples set forth hereinbelow are being submitted to illustrate embodiments of the present disclosure. These examples are intended to be illustrative only and are not intended to limit the scope of the present disclosure. Also, parts and percentages are by weight unless otherwise indicated. Comparative examples and data are also provided.

Computer Modeling

Charging evaluation has been performed by computer modeling data which can reliably predict charging performance of xerographic materials. To model the electron transfer from the carrier coating resin to the silica toner additive, a carrier resin silica complex was studied, comprised of a trimer unit of the carrier resin and a silica surface model (further described below). Silica was chosen as silica is the dominant charging material in most negative charging toners. Thus, if by carrier design we can control the silica charge, we can control the charge in the toner.

It is known in the art that in the usual intra-molecular electron transfer, within a single material, the adsorption of sufficient energy from a photon or collision or thermal energy could result in transfer of an electron from the highest occupied molecular orbital (HOMO) to the lowest unoccupied molecular orbital (LUMO). Since the electron and hole (left when the electron leaves the HOMO) are both on the same molecule, there is no net charge on the molecule. The size of the energy gap determines the amount of energy require to transfer the electron between the orbitals. So as shown in FIG. 1, both the carrier resin and toner additive, before they come in contact, have a HOMO and a LUMO and an associated gap. It should be noted that there are also potentially other energy levels above the LUMO (known as LUMO+1, LUMO+2, etc. of increasing energy) and below the HOMO (known as HOMO−1, HOMO−2, etc of decreasing energy). Thus, it is generally possible to transfer an electron from a HOMO−n to a LUMO+m, where n, m>0 within a material. As used herein, HOMOn=0 is written as HOMO, and LUMOm=0 as LUMO for simplicity.

In the computer modeling work of the current embodiments, it has been shown that on contact of two materials, such as the toner additive and the carrier, a number of different possibilities arise for the location of the HOMO−n and the LUMO+m, and thus the result of charge transfer has a number of different possibilities. The contact of the two materials may result in the HOMO−n being located on the carrier resin and the LUMO+m on the toner additive. In this situation the electron transfer will charge the carrier resin positive and the toner additive negative, which is desired for negative charging toner. This is called the forward energy gap. On the other hand, if the LUMO+m is located on the carrier resin and the HOMO−n is on the toner additive the electron transfer will charge the toner additive positive and the carrier resin negative, the opposite of what is desired for negative charging toner. This is called the reverse energy gap. The HOMO and LUMO may be located on just one molecule, as shown in FIG. 1, or could be partially on both molecules. The disposition of these resulting frontier molecular orbitals is a result of the properties of the two materials and their interaction, which also depends on the orientation of the two molecules in contact. In a bulk sample of material different orientations of the molecules on contact will be obtained randomly. Thus, the overall charge transferred is the sum of the different processes. The important processes for charge transfer will be that of the lowest energy, so in the collection of the modeling data the process is to look at different orientations of contact and identify the lowest energy gap for the forward charge transfer desired (negative toner charge) and the lowest energy gap for reverse charge transfer (positive toner charge).

Figure 2:
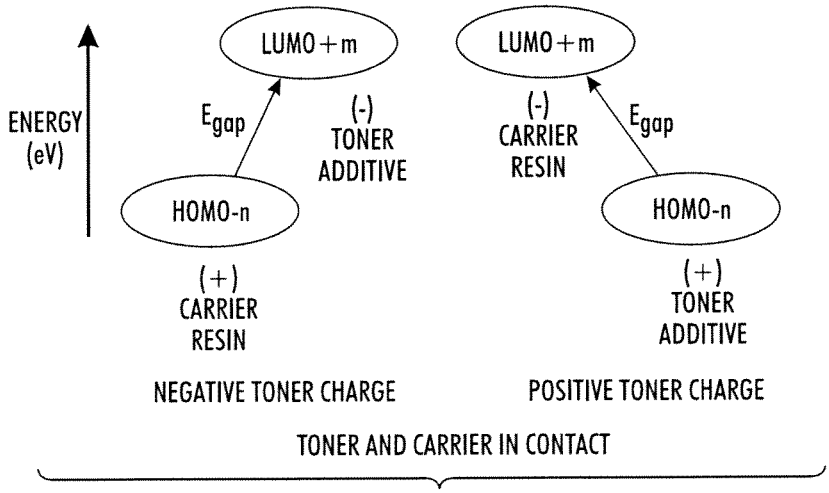
FIG. 2 shows a schematic diagram of HOMO and LUMO energies for carrier resin and toner additive.

FIG. 2 provides a schematic diagram of HOMO and LUMO energies for carrier resin and toner additive. The transfer on the left shows the forward energy gap for negative toner charge, that on the right shows the reverse transfer gap for positive toner charge. Thus, the modeling shows that for excellent high negative toner charge in charging of toners with silica and carriers with a polymeric resin coating, there are two key attributes:

1) the minimum energy gap for the forward charge transfer needs to be low; and
2) the minimum reverse energy gap should be higher than the forward gap (a negative gap difference, subtracting 1) from 2)

Table 1 below shows the modeling data for electron charge transfer to silica (desirable) to electron charge transfer to polymer (not desirable) for a number of different coating materials. The modeling data shows that with the methyl methacrylate (MMA) repeat unit the gap for forward transfer is lower than the gap for reverse transfer (4.793 vs. 6.236 eV), predicting positive charge for MMA and negative charge for the toner silica, as desired. A similar conclusion is reached for the cyclohexyl methacrylate (CHMA) repeat unit, the modeling shows charging will be similar to MMA, which is what is observed under dry conditions. We can use MMA and CHMA as references, so materials that have a lower forward vs. reverse energy gap and a lower forward energy gap than MMA (or CHMA) will charge lower, if the materials have a higher forward energy gap they will charge lower but still be positive. If the forward energy gap is higher than the reverse gap, the carrier resin will charge negative, and the toner silica positive.

The next entry shows that adding one unit of 2-(dimethyl amino) ethyl methacrylate (DMAEMA) to two of CHMA improves charge transfer by lowering the forward energy gap. The next entry shows that DMAEMA alone has much lower forward gap energies. As predicted by modeling, it is observed experimentally that adding even small amounts of DMAEMA to CHMA does increase the toner charge substantially. Thus, the DMAEMA entry is a good reference for the inventive examples provided in the table for very strongly positive charging carrier charge control agents.

The next entries in the table show the inventive examples. In all cases the energy gaps to forward transfer are as low as the CHMA/DMAEMA comparative example and in two cases about as low as DMAEMA. Also, very desirably, all of the inventive monomers have higher reverse gaps, which will reduce back transfer of charge in the wrong direction (the direction of positive toner charge), and thus which will provide higher net charge transfer. Thus, all of these monomer units are predicted to be strong to very strong positive charge control agents for carrier. 4t-ButylPMA has a benchmark low energy gap for the forward charge transfer of 3.11, and thus is expected to be the most effective charge control agent (more effective than DMAEMA).

effect on Tg. Linear alkyl methacrylates with longer chains and thus higher C/O ratios have very low Tg: for methacrylates, methyl is 100° C., ethyl 65° C., butyl 20° C., and hexyl −3° C. Thus, for the preferred C/O ratio, above at least 4, the Tg is too low for the long aliphatic chains. Note acrylates (as opposed to methacrylates) are generally unsuitable, as they have much lower Tg. Finally, DMAEMA alone is unsuitable, with a Tg of 18° C., though copolymerized with CHMA, at least in small quantities, it doesn't affect Tg strongly overall. However, the local Tg of the charging monomer is very low due to the high flexibility and mobility. This softens the resin at these points, which potentially can affect durability. Also, the increased flexibility and mobility allows more easy access of water to the charging site, degrading RH sensitivity. Clearly, the most favorable structures for high C/O ratio and a high Tg are a cyclic ring, like the 6-membered cylohexyl ring in CHMA. While the Tg of the inventive methacrylates

TABLE 1*

| | Polymer Monomer Repeat Unit(s) | Modeling Data Charge Transfer Polymer to Silica (eV) | Modeling Data Charge Transfer Silica to polymer (eV) | Modeling Data Positive Carrier Charge Prediction | Experimental Measured Charging | Calc'd C/O Ratio | Experimental Measured RH Ratio |
|---|---|---|---|---|---|---|---|
| Comparative Examples | MMA | 4.79 | 6.24 | Good | Good | 2.5 | Worse than CHMA |
| | CHMA | 4.67 | 6.5 | Good | Good | 5.0 | Good |
| | CHMA/DMAEMA | 4.28 | 6.26 | Increased | Good-higher | ≈5 | Worse than CHMA with more DMAEMA |
| | DMAEMA | 3.73 | 5.23 | Much increased | No data | 4 | No data |
| Inventive Examples | 4MPMA | 3.81 | 6.10 | Much increased | No data | 5 | No data |
| | 4t-ButylPMA | 3.11 | 6.51 | Much increased | No data | 6.5 | No data |
| | acetylpiperidin-4-yl (NAc4PMA) | 4.19 | 5.90 | Increased | No data | 3.67 | No data |
| | 1-pivaloylpiperidin-4-yl MA (NP4PMA) | 4.09 | 5.95 | Increased | No data | 4.33 | No data |
| | piperidin-1-yl MA (PipMA) | 4.26 | 5.75 | Increased | No data | 4.5 | No data |
| | 2,2,6,6-tetramethylpiperidin-1-yl (TMPipMA) | 4.23 | 5.98 | Increased | No data | 6.5 | No data |
| | TMoMA | 3.72 | 5.79 | Increased | No data | 4 | No data |

*Note error in energies shown in Table 1 is ≈0.045 eV (the error mostly arising from the size difference among polymer trimer models).

A third key attribute is that the resin has a high C/O ratio monomer. Thus, MMA C/O ratio is low at 2.5 and has a poor RH sensitivity. CHMA has a C/O ratio of 5, and thus much improved RH ratio. DMAEMA has a lower C/O ratio of 4 than CHMA, and thus can degrade the RH sensitivity, so must be used in small amounts to maintain an overall low water content. However, since N is the charge site as shown by the modeling, the low C/O ratio of DMAEMA around the charge site allows local water adsorption on the N, resulting in the degraded RH sensitivity. Desirably, all of the inventive examples have higher C/O ratio around the N repeat unit than DMAEMA, excepting TMoMA which has the same C/O ratio. As evident from Table 1, a number of the inventive examples have much higher C/O ratio: the 4MPMA and TMPipMA with C/O ratios of 6.5, even higher than the base CHMA.

The fourth key attribute is the Tg of the resin. Replacing the methyl group in MMA with the cyclic CHMA group has little here have not been measured, they are all based on the 6-membered ring of cyclohexyl, and thus all are expected to have similar high Tg for the repeat unit. The incorporation of N may actually increase Tg slightly due to more polar interactions, though the pendant groups on some of these materials may slightly lower the Tg. But all are expected to be much preferred over DMAEMA.

Computer Modeling Procedure

For all substituted methacrylates, a trimer was used to represent the polymer. To distinguish possible effect of C rich and O rich functional group (alkyl/aromatic and acyl) in the polymer, all three acyl groups were designed to coordinate to the same side.

To mimic the surface hydroxyl group of silica model, a one layer cylinder-like silica model was used to design the surface treated silicas with the formula $Si_{12}O_{32}H_{16}$. In this model, all silicons were in tetrahedral geometry and connected by oxygen. The edge of this cylinder was terminated by two hydroxyl groups to represent the geminal silanols [$Si(OH)_2$], which are typical on the (100) surface of β-cristobalite, identified experimentally on the amorphous silica surface as one of the two types of surface hydroxyl group of untreated silica. (Le'onardelli, S.; Facchini, L.; Fretigny, C.; Tougne, P.; Legrand, A. P. *J. Am. Chem. Soc.* 1992, 114, 6412; Vigné-Maeder and P. Sautet, J. Phys. Chem. B 101, 8197 1997.)

All calculations were performed with the DMol3 module from the Accelrys Materials Studio 4.2 commercial software package. We used Density functional theory (DFT) for the study of surface electronic properties of all models and the coupled toner/carrier complexes. Due to its main advantages of high accuracy at reasonable computational efficiency, DFT method has been successfully applied to the electronic structure modeling of materials.

Recent extensions of the DMol3 density functional method are designed to do electronic structure calculations for local and gradient-dependent functional, depending on the accuracy needed. In this study, Perdew's 91 generalized gradient approximation (PW91 PW91) were employed as the density functional method. For basis sets, a double numerical basis set with d-polarization functions (DND) was used for all calculations. For different basis set types, it has been reported that DND performs better than a Gaussian-type basis set of the same size, which is 6-31G*. The DND numerical solutions can give highly accurate DFT solutions for the separated atoms limit for molecular and solids calculations.

The initial structure, optimized structure and electronic properties of adsorbed polymer complexes on the silica were studied. The geometry optimization convergence was achieved when the energy, gradient, and displacement were lower than 2×10-5 Ha, 4×10-3 Ha/Å, and 5×10-3 Å, respectively. Here Ha is the Hartree Atomic units (au), where 1 au=$4.359\times10^{-18}$ Joules. The calculations of HOMO-LUMO orbitals have been performed to understand the direction of charge transfer of above models and to identify the most essential factor that could affect electron transfer in these complex models.

Electron transfer active sites on different materials are crucial to triboelectric charge since they are the root and destination of electron transfer and their relative ability of donating and accepting electrons will directly determine the triboelectric charge properties of certain toner/carrier pairs.

To further explore the reverse gap and the forward gap of charge transfer, the excited orbitals for above systems were studied. Generally, 10 levels of orbital above (M+9) and below (n-9) the Fermi level were calculated. The lowest energy gap for both forward electron transfer and reverse electron transfer were collected from this set of twenty orbitals. The calculation errors of these energy gaps are evaluated by comparing the forward and reverse electron transfer barrier of DMEAMA dimer and trimer/Silica complexes.

Example 1

Monomer Synthesis

A few of the inventive monomers have now been synthesized.

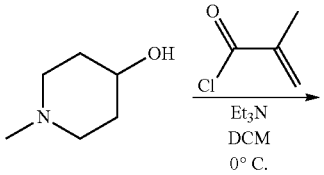

-continued

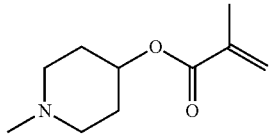

1-methylpiperidin-4-yl methacrylate

N-methyl-4-piperidine (14.32 g, 0.124 mol) and triethylamine (19.0 mL, 0.194 mol) were dissolved in anhydrous dichloromethane (30 mL) and cooled to 0° C. Methacryloyl chloride (13 mL, 0.133 mol) was then added slowly, dropwise. The reaction was then slowly warmed to room temperature. After stirring overnight, diethyl ether (300 mL) was added and the reaction mixture was washed with deionized water (150 mL). The water layer was separated and back extracted with diethyl ether (100 mL). Both organic phases were then combined and washed with 100 mL portions of 1 M NaOH, deionized water, and brine. After drying over sodium sulfate and filtering, the product was concentrated by rotary evaporation and dried in vacuo to give 1-methylpiperidin-4-yl methacrylate as an amber liquid (21.11 g, 93%). The product was found to be unstable and formed a gel over several days stored in the freezer (−20° C.).

$^1$H NMR (600 MHz, $CDCl_3$, ppm) δ 6.00 (s, 1H), 5.44 (s, 1H), 4.76 (m, 1H), 2.51 (m, 2H), 2.18 (m, 5H), 1.84 (m, 5H), 1.67 (m, 2H).

$^{13}$C NMR (150 MHz, $CDCl_3$, ppm) δ 166.69, 136.75, 125.18, 69.62, 52.77, 46.19, 30.79, 18.30.

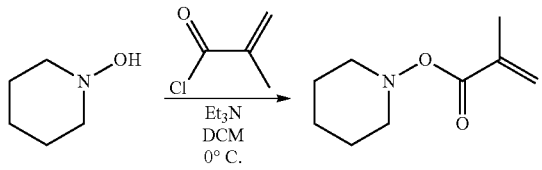

piperidin-1-yl methacrylate

A few of the inventive 1-hydroxypiperidine (0.96 g, 9.49 mmol) and triethylamine (1.50 mL, 10.8 mmol) were dissolved in anhydrous dichloromethane (40 mL) and cooled to 0° C. Methacryloyl chloride (1 mL, 10.2 mmol) was then added slowly, dropwise. The reaction was then slowly warmed to room temperature. After 2.5 h, the reaction mixture was washed with deionized water (40 mL), 1 M NaOH (20 mL), deionized water (20 mL), 5% citric acid (20 mL), and brine (20 mL). After drying over sodium sulfate and filtering, the product was concentrated by rotary evaporation and dried in vacuo to give and amber liquid. Flash chromatography on silica gel, eluting with dichloromethane, followed by 1-5% methanol:dichloromethane afforded piperidin-1-yl methacrylate as an amber liquid (1.23 g, 76%).

$^1$H NMR (600 MHz, $CDCl_3$, ppm) δ 5.98 (s, 1H), 5.46 (m, 1H), 4.06 (br m, 2H), 2.61 (br m, 2H), 1.87 (s, 3H), 1.74-1.66 (br m, 5H), 1.57 (br m, 1H), 1.19 (br m, 1H).

$^{13}$C NMR (150 MHz, $CDCl_3$, ppm) δ 165.54, 135.84, 125.14, 57.38, 24.97, 23.38, 18.44.

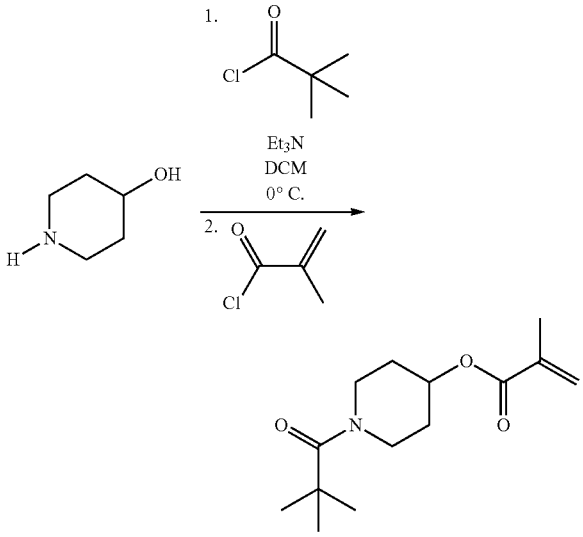

1-pivaloylpiperidin-4-yl methacrylate 4-hydroxypiperidine (8.14 g, 80.5 mmol) and triethylamine (12.5 mL, 89.6 mmol) were dissolved in anhydrous dichloromethane (50 mL) and cooled to 0° C. A dichloromethane solution (30 mL) of trimethyl acetyl chloride (9.0 mL, 82.4 mmol) was then added slowly, drop wise, and then the mixture was slowly warmed to 23° C. over 3 h. The mixture was then cooled back down to 0° C., more triethylamine (12.5 mL, 89.6 mmol) was added, followed by the slow, drop wise addition of methacrylyl chloride (8.7 mL, 89.0 mmol). 4-methoxyphenol (12.3 mg, x mmol) was added and the reaction was allowed to slowly warm to 23° C. After stirring overnight, the reaction mixture was successively washed 50 mL portions of deionized water, 1 M NaOH, deionized water, 5% citric acid, and brine. After drying over sodium sulfate and filtering, the product was concentrated by rotary evaporation and dried in vacuo to give a brown solid. The solid was triturated with hexanes, filtered, washed with hexanes, and dried in vacuo to give 1-pivaloylpiperidin-4-yl methacrylate as a beige solid (1.87 g, 9%). The filtrate was concentrated by rotary evaporation and purified by flash chromatography on silica gel (eluting with ethyl acetate:hexanes (1:4-1:1)) to give a second batch of 1-pivaloylpiperidin-4-yl methacrylate as a pale yellow solid (6.77 g, 33%).

$^{1}$H NMR (600 MHz, $CDCl_3$, ppm) δ 6.10 (s, 1H), 5.56 (m, 1H), 5.05 (m, 1H), 3.85 (m, 2H), 3.49 (m, 2H), 1.93 (s, 3H), 1.90 (m, 2H), 1.68 (m, 2H), 1.26 (m, 9H).

$^{13}$C NMR (150 MHz, $CDCl_3$, ppm) δ 176.49, 166.73, 136.69, 125.74, 69.82, 42.50, 38.90, 31.15, 28.58, 18.44.

Example 2

Preparation of Control CHMA Latex and CHMA Latex with 1% DMAEMA

A latex emulsion comprised of polymer particles generated from the emulsion polymerization was prepared as follows. A surfactant solution consisting of 2.6 mmol sodium lauryl sulfate (anionic emulsifier) and 21 mole of de-ionized water was prepared by mixing for 10 minutes in a beaker. The aqueous surfactant solution was then transferred into the reactor. The reactor was then continuously purged with nitrogen while being stirred at 450 RPM. In a separate container 665.7 mmol of cyclohexylmethacrylate was weighed, and for latex with 1% DMAEMA, it was mixed with 7.2 mmol of dimethylaminoethylmethacrylate (DMAEMA). Ten percent by weight of this monomer was added to the aqueous surfactant mixture as a seed. The reactor was then heated up to 65° C. at a controlled rate, and held there. Separately 2 mmol of ammonium persulfate initiator was dissolved in 222 mmol of de-ionized water to form the initiator solution. The initiator solution is then slowly charged into the reactor and after 40 minutes the rest of the monomer is continuously fed in using a metering pump at a rate of 0.8% by weight/min. Once all the monomer is charged into the main reactor, the temperature is held at 65° C. for an additional 2 hours to complete the reaction. Full cooling is then applied and the reactor temperature is reduced to 35° C. The product was finally collected into a container and dried to a powder form using a freeze-drier.

Example 3

Preparation of CHMA Latex with 2 Mol % NP4PMA

Latex emulsions comprised of polymer particles generated from the emulsion polymerization of cyclohexylmethacrylate and novel charge control monomer with partitioned surfactant were prepared as follows:

In a 1 L Büchi was added 0.0111 mmol (3.20 mg) of sodium lauryl sulfate surfactant in 14.05 moles (253 g) of de-ionized water. The reactor was heated to 65° C. and stirred at 450 RPM. Meanwhile in a beaker was added 2.43 mmol (0.701 g) of sodium lauryl sulfate surfactant, 7086 mmol (128 g) de-ionized water, 666 mmol (112 g) cyclohexylmethacrylate monomer, and 13.32 mmol (3.37 g) NP4PMA. The contents in the beaker were stirred at 800 RPM to emulsify the monomer/aqueous surfactant solution.

10 weight % of monomer seed was taken out and added to the Büchi. Then to the reactor was added 2.1 mmol (0.470 g) ammonium persulfate initiator dissolved in 221 mmol (3.98 g) de-ionized water. After 40 minutes of the Büchi stirring at 450 RPM and 65° C., the contents from the beaker containing the monomers were slowly metered in using a pump at a rate of 0.9 g per minute. Once all the monomer emulsion was charged into the Büchi, the temperature was held at 65° C. for an additional 3 hours to complete the reaction. Full cooling was applied to the reactor to bring the temperature to below 35° C. A liquid sample was taken to measure particle size on a Nanotrac Particle Size Analyzer (Microtrac) and zeta potential on a Zetasizer (Malvern). The rest of the product was dried to a powder form using a freeze-drier apparatus.

Example 4

Preparation of CHMA Latex with 4 Mol % pipMA

Latex emulsions comprised of polymer particles generated from the emulsion polymerization of cyclohexylmethacrylate and novel charge control monomer with partitioned surfactant were prepared as follows:

In a 1 L Büchi was added 0.0111 mmol (3.20 mg) of sodium lauryl sulfate surfactant in 14.05 moles (253 g) of de-ionized water. The reactor was heated to 65° C. and stirred at 450 RPM. Meanwhile in a beaker was added 2.43 mmol (0.701 g) of sodium lauryl sulfate surfactant, 7086 mmol (128 g) de-ionized water, 666 mmol (112 g) cyclohexylmethacrylate monomer, and 26.6 mmol (4.51 g) pipMA. The contents in the beaker were stirred at 800 RPM to emulsify the monomer/aqueous surfactant solution.

10 weight % of monomer seed was taken out and added to the Büchi. Then to the reactor was added 2.1 mmol (0.470 g) ammonium persulfate initiator dissolved in 221 mmol (3.98 g) de-ionized water. After 40 minutes of the BUN stirring at 450 RPM and 65° C., the contents from the beaker containing the monomers were slowly metered in using a pump at a rate of 0.9 g per minute. Once all the monomer emulsion was charged into the Büchi, the temperature was held at 65° C. for an additional 3 hours to complete the reaction. Full cooling was applied to the reactor to bring the temperature to below 35° C. A liquid sample was taken to measure particle size on a Nanotrac Particle Size Analyzer (Microtrac) and zeta potential on a Zetasizer (Malvern). The rest of the product was dried to a powder form using a freeze-drier apparatus.

Latex properties are shown in Tables 2 and 3 for all latexes prepared in a 1 L Büchi. As can be seen. Tg is similar to CHMA for all materials prepared to date.

TABLE 2

| | | DSC Analysis | | | Acid Value | GPC | | | |
|---|---|---|---|---|---|---|---|---|---|
| | | Tg | Tg | Tg | Mg | | | | |
| Sample ID | Type/ Drying Method | onset (° C.) | mid (° C.) | offset (° C.) | KOH/ g resin | Mw (K) | Mn (K) | PD | Mp (K) |
| CHMA | Non-partitioned/ freeze dry | 104.7 | 109.8 | 114.9 | N/M | 529 | 209 | 2.53 | 404 |
| CHMA 1% DMAEMA | Non-partitioned/ freeze dry | 95.5 | 104.8 | 114.1 | N/M | 557 | 213 | 2.61 | 467 |
| CHMA 3.68 mol % pipMA | Partitioned/ freeze dry | 103.8 | 112.4 | 121.0 | 7.24 | 302 | 96 | 3.15 | 176 |
| CHMA 2.0 mol % NP4PMA | Partitioned/ freeze dry | 79.0 | 88.3 | 97.6 | 3.03 | 589 | 216 | 2.84 | 417 |

TABLE 3

| | | GC | GC | PSD (Nanotrac) | | Zeta |
|---|---|---|---|---|---|---|
| Sample ID | Type/Drying Method | % CCA Residual | % CHMA Residual | D50 (nm) | MV (nm) | Potential (mV) |
| CHMA | Non-partitioned/ freeze dry | ND | 0.22 | 89 | 92 | Particle is stable |
| CHMA 1% DMAEMA | Non-partitioned/ freeze dry | ND | 0.62 | 92 | 96 | Particle is stable |
| CHMA 3.68 mol % pipMA | Partitioned/ freeze dry | ND | 2.11 | 97.9 | 100.8 | Particle is stable |
| CHMA 2.0 mol % NP4PMA | Partitioned/ freeze dry | ND | 0.27 | 112.8 | 115.6 | Particle is stable |

N/M = not measured
N/D = not detected

Summary

The present embodiments provide cyclic aliphatic monomers containing N for carrier applications. The advantages of these monomers are that the cyclic ring provides more restricted rotation and thus higher Tg and more rigidity than the aliphatic variants. In particular, as the amount of carbon in the N containing moiety increases in the aliphatic non-cyclic monomers, the mobility increases dramatically, reducing Tg and softening the resin compared to the cyclic monomers. The restricted rotation and higher carbon content in the N containing moiety is also anticipated to reduce RH sensitivity, due to the increase in the C/O ratio of the repeat unit containing the charging site, the N atom, and due to the restricted mobility which will reduce opportunity for water to be adsorbed near the charging site.

It will be appreciated that several of the above-disclosed and other features and functions, or alternatives thereof, may be desirably combined into many other different systems or applications. Also various presently unforeseen or unanticipated alternatives, modifications, variations or improvements therein may be subsequently made by those skilled in the art, which are also intended to be encompassed by the following claims.

Unless specifically recited in a claim, steps or components of claims should not be implied or imported from the specification or any other claims as to any particular order, number, position, size, shape, angle, color or material.

All references cited herein are herein incorporated by reference in their entireties.

What is claimed is:

1. A toner carrier comprising:

a carrier core; and a carrier coating disposed over the carrier core, wherein the carrier coating comprises one or more monomers having at least one ester functional group and at least one cyclic aliphatic group containing at least one nitrogen atom in the ring structure; wherein the one or more monomers has the following formula:

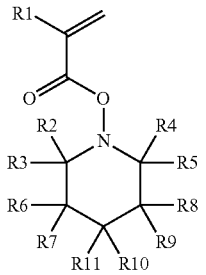

wherein $R_1$ is H, or $CH_3$, each $R_2$, $R_3$, $R_4$, $R_5$, $R_6$, $R_7$, $R_8$, $R_9$, $R_{10}$ is independently H, $CH_3$, or $CH_2CH_3$.

2. The toner carrier of claim 1, wherein the ester containing resin is an acrylate or a methacrylate.

3. The toner carrier of claim 1, wherein the one or more monomers are selected from the group consisting of piperidin-1-yl methacrylate , 2,6,6-tetramethylpiperidin-1-yl, and mixtures thereof.

4. The toner carrier of claim 1, having a Tg of from about 80 to about 200° C.

5. The toner carrier of claim 1, wherein the one or more monomers have a C/O ratio greater than 4.

6. The toner carrier of claim 1 having a C/O ratio greater than 4.

7. The toner carrier of claim 1, wherein the one or more monomers have a number average molecular weight ($M_n$), as measured by gel permeation chromatography (GPC) of, from about 60,000 to about 400,000.

8. The toner carrier of claim 1, wherein the one or more monomers are present in the carrier coating in an amount of from about 0.05% to about 100% by weight of the total weight of the carrier coating.

9. The toner carrier of claim 1 being in the form of particles with an average particle size of from about 50 nm to about 500 nm.

10. A toner carrier comprising:

a carrier core; and a carrier coating disposed over the carrier core, wherein the carrier coating comprises one or more monomers having at least one ester functional group and at least one cyclic aliphatic group containing at least one nitrogen atom in the ring structure; wherein the one or more monomers are selected from the group consisting of 1-acetylpiperidin-4-yl, 1-pivaloylpiperidin-4-yl methacrylate, piperidin-1-yl methacrylate, 2,6,6-tetramethylpiperidin-1-yl, thiomorpholin-4-yl methacrylate and mixtures thereof.

11. The toner carrier of claim 10, wherein the carrier coating is powder coated on to the carrier core.

12. The toner carrier of claim 10, wherein the carrier coating is applied to the carrier core by applying a process selected from the group consisting of cascade roll mixing, tumbling, milling, shaking, electrostatic powder cloud spraying, solution coating, fluidized bed, electrostatic disc processing, electrostatic curtains and combinations thereof.

13. The toner carrier of claim 10, further comprising one or more of a carbon black, a surfactant, a wax or a colorant.

14. The toner carrier of claim 10, wherein said particle is magnetic.

15. The toner carrier of claim 10, wherein the carrier core is of a material selected from the group consisting of iron, steel, ferrites, magnetites, nickel and combinations thereof.

16. A developer comprising:

a toner; and a toner carrier, the toner carrier comprising a carrier core, and a carrier coating disposed over the carrier core, wherein the carrier coating comprises one or more monomers having at least one ester functional group and at least one cyclic aliphatic group containing at least one nitrogen atom in the ring structure; wherein the one or more monomers are selected from the group consisting of 1-acetylpiperidin-4-yl, 1-pivaloylpiperidin-4-yl methacrylate, piperidin-1-yl methacrylate , 2,6,6-tetramethylpiperidin-1-yl, thiomorpholin-4-yl methacrylate and mixtures thereof.

17. The developer of claim 15, wherein the toner comprises at least one silica surface additive.

18. The developer of claim 15, wherein the toner is an emulsion aggregation toner.

19. A toner carrier comprising:

a carrier core; and a carrier coating disposed over the carrier core, wherein the carrier coating comprises one or more monomers having at least one ester functional group and at least one cyclic aliphatic group containing at least one nitrogen atom in the ring structure; wherein the one or more monomers are selected from the group consisting of 1-acetylpiperidin-4-yl, 1-pivaloylpiperidin-4-yl methacrylate, thiomorpholin-4-yl methacrylate and mixtures thereof.

* * * * *